US008424813B1

(12) United States Patent
Voelkerding et al.

(10) Patent No.: US 8,424,813 B1
(45) Date of Patent: Apr. 23, 2013

(54) ELEVATED FROG AND RAIL TRACK ASSEMBLY

(75) Inventors: Daniel Voelkerding, Cleveland, OH (US); James A. Remington, Sheffield Village, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 0 days.

(21) Appl. No.: 13/357,289

(22) Filed: Jan. 24, 2012

Related U.S. Application Data

(60) Provisional application No. 61/435,970, filed on Jan. 25, 2011.

(51) Int. Cl.
*E01B 7/10* (2006.01)

(52) U.S. Cl.
USPC ..... 246/468; 246/274; 246/382

(58) Field of Classification Search ..... 246/274, 246/275, 382–392, 468–471
See application file for complete search history.

(56) References Cited

U.S. PATENT DOCUMENTS

| | | | | |
|---|---|---|---|---|
| 4,015,805 | A | | 4/1977 | Friesenbichler |
| 4,144,442 | A | | 3/1979 | Augustin et al. |
| 4,159,090 | A | | 6/1979 | Pirker |
| 4,168,817 | A | | 9/1979 | Pirker et al. |
| 4,169,745 | A | | 10/1979 | Moser et al. |
| 4,469,299 | A | | 9/1984 | Csontos |
| 4,514,235 | A | | 4/1985 | Augustin et al. |
| 4,516,504 | A | | 5/1985 | Brems et al. |
| 4,589,617 | A | | 5/1986 | Kempa |
| 4,624,428 | A | | 11/1986 | Frank |
| 4,637,578 | A | | 1/1987 | Frank |
| 4,756,477 | A | | 7/1988 | Schumaker |
| 4,908,993 | A | | 3/1990 | Buhler |
| 4,948,073 | A | | 8/1990 | Edwards et al. |
| 4,953,814 | A | | 9/1990 | Oswald et al. |
| 4,982,919 | A | * | 1/1991 | Durchschlag et al. ..... 246/382 |
| 5,042,755 | A | | 8/1991 | Testart |
| 5,082,214 | A | | 1/1992 | Testart |
| 5,184,791 | A | | 2/1993 | Kais et al. |
| 5,375,797 | A | | 12/1994 | Willow |
| 5,522,570 | A | | 6/1996 | Benenowski et al. |
| 5,531,409 | A | | 7/1996 | Willow |
| 5,544,848 | A | * | 8/1996 | Kuhn et al. ..... 246/276 |
| 5,560,571 | A | * | 10/1996 | Remington ..... 246/468 |
| 5,595,361 | A | * | 1/1997 | Remington et al. ..... 246/276 |
| 5,598,993 | A | | 2/1997 | Kuhn et al. |
| 5,743,496 | A | | 4/1998 | Atkinson, Jr. |
| 5,746,400 | A | * | 5/1998 | Remington et al. ..... 246/465 |
| 5,782,437 | A | | 7/1998 | Irie et al. |
| 5,806,810 | A | | 9/1998 | Young et al. |
| 5,810,298 | A | | 9/1998 | Young et al. |
| 6,138,958 | A | | 10/2000 | Irie et al. |
| 6,158,697 | A | | 12/2000 | Young et al. |
| 6,164,602 | A | * | 12/2000 | Kuhn et al. ..... 246/382 |
| 6,177,205 | B1 | | 1/2001 | Kais et al. |
| 6,224,023 | B1 | | 5/2001 | Young et al. |
| 6,266,866 | B1 | | 7/2001 | Ramirez et al. |
| 6,276,642 | B1 | * | 8/2001 | Young et al. ..... 246/276 |
| 6,286,791 | B1 | * | 9/2001 | Young et al. ..... 246/382 |
| 6,340,140 | B1 | | 1/2002 | Lochschmidt |
| 6,543,728 | B1 | | 4/2003 | Benenowski et al. |

(Continued)

*Primary Examiner* — Jason C Smith
(74) *Attorney, Agent, or Firm* — Rober A. Gilcrest

(57) ABSTRACT

The invention is a frog panel assembly for a railway turn-out switch, as well as a rail intersection design and a frog casting therefor.

20 Claims, 21 Drawing Sheets

U.S. PATENT DOCUMENTS

| | | | | |
|---|---|---|---|---|
| 6,732,980 | B2 * | 5/2004 | Hein | 246/455 |
| 6,994,299 | B2 * | 2/2006 | Marron | 246/382 |
| 7,083,149 | B2 | 8/2006 | Heinze et al. | |
| 7,121,513 | B2 | 10/2006 | Leitner | |
| 7,377,471 | B1 | 5/2008 | Compton et al. | |
| 2004/0065784 | A1 * | 4/2004 | Hein | 246/468 |
| 2004/0124316 | A1 | 7/2004 | Marron | |
| 2005/0067535 | A1 | 3/2005 | Leitner | |
| 2005/0145754 | A1 | 7/2005 | Heinze et al. | |
| 2006/0202047 | A1 | 9/2006 | Klauder | |
| 2007/0001060 | A1 * | 1/2007 | Mugg | 246/385 |
| 2007/0007394 | A1 * | 1/2007 | Hein et al. | 246/382 |
| 2010/0270436 | A1 * | 10/2010 | Wientges et al. | 246/407 |

* cited by examiner

ELEVATED FROG AND RAIL TRACK ASSEMBLY

RELATED APPLICATION DATA

This application claims the priority benefit of U.S. Provisional Application Ser. No. 61/435,970, filed Jan. 25, 2011, which is hereby incorporated in its entirety herein by reference.

FIELD OF THE INVENTION

The present invention relates to a railroad track and switching assemblies.

BACKGROUND AND SUMMARY OF THE INVENTION

The present invention relates to an elevated frog for a railway switch panel. A railway frog is employed where one track crosses another. For example, in a turnout, a switch will selectively switch a train from a main track to a turnout track. As the turnout track progresses in a curve from the switch, one of the rails must cross a rail of the main track. The junction assembly at such crossing is called a frog.

Typically, railroad turnout frogs are the highest maintenance item in a turnout. The flangeway or gap in the frog is necessary to allow the wheels of a train to cross a rail. When the wheels cross the gap they generate impacts that adversely affect the frog, wheels, and the track structure. Although each of the foregoing designs is workable, an improved design that further reduces the railroad maintenance would be desirable.

In providing for rail switching, it is important to accommodate several aspects relating to the main line running and turn out rail line.

In order to allow the train car wheel set to cross onto the turnout rail line, it must be raised to a height to allow it to cross the main running rail, and then returned to the base running height.

Typically this is accomplished by using frog casting disposed on either side of the main line rail on the turnout side. These castings are designed to lift the wheel, direct it through the transition zone over the turn-out side main line rail, and capture the wheel, allowing it to relax to the established rail elevation. For these purposes, the dual frogs are specially cast and custom machined to provide the required shaping, such as that to provide the required ramping and channeling for support and capture of the wheel tread and flange, to be able to firmly and accurately provide mechanical action under high strain and impact conditions.

It is also typical that frog designs accommodate canted main running rails used in higher speed track sections, such as those that may accommodate mainline speeds of 50-60 mph.

It is advantageous to be able to provide this mechanical action with reduced expense and effort associated with the production of relatively expensive multiple castings that require custom machining that are customary in the industry. In this regard, frog castings typically incorporate ramping in the design of the main body casting that require rather complex post-casting machining, and it is beneficial to reduce or eliminate complex ramping within the body of the casting.

It is also best to provide a uniform, unbroken wheel path that distributes load and reduces wheel and frog wear, such as may be accomplished by providing a horizontal wheel path that is not interrupted by wheel-to-rail interface.

Typically dual frog casting systems must incorporate all of the required ramping with the length of the casting, which requires relatively larger castings to distribute the ramping length to reduce inertial bounce as the wheel sets pass over the main line rail. This makes typical frog casting systems relatively large and expensive. Accordingly, it would be beneficial to reduce the overall casting size, and thereby reduce the initial cost of frog production while at the same time reducing the cost of attendant repair and maintenance.

It is also beneficial to provide a crossing system that may be made and installed simply, while also being adapted for prefabrication and installation, and one that is relatively easy to assemble and repair. In this regard, it is desirable to eliminate multiple castings, make their production easier and less expensive, and provide frog panels that are adapted to reduce overall track and crossing wear associated with long term use, and that accommodate changes in wheel geometry as wheel degradation occurs over the wheel's operational life cycle.

The embodiments of the invention described herein addresses the shortcomings of the prior art.

SUMMARY OF THE INVENTION

In general terms, the invention may be described as including a frog panel assembly for a railway turn out switch, as well as a rail intersection design and a frog casting therefor.

The present invention may be characterized as a frog containing panel system, and the frog and rail intersection used therein.

The present invention principally features the use of the toe side turnout rail to raise the wheel set, with the heel side frog being of rather simple construction and providing substantially horizontal capture and return to a tread bearing condition and normal operating height.

The present invention thus provides several concomitant advantages over the prior art. The system of the present invention allows the required ramping for the approaching wheel set to be incorporated into the rail portion of the design outside the main body casting, so as to eliminate the need for a toe-side frog casting, and consequently eliminates the need for ramping within the body of such a toe-side frog casting, thus reducing the wear on the casting and attendant need for replacement over time. This reduces initial and operational costs.

By using the run-up rail section of the rails within the panel to raise the on-coming wheel set, the length of the ramping can be extended so the slope is more gradual so as to offer greater operating speed but still within the industry guidelines as reflected in Transportation Research Board Research Report 57. This also removes the need for a toe-side frog casting of substantial size that would be required otherwise.

The present invention also includes ramped rails extending from the heel-side frog. This also minimizes the extent to which the decline of the raised wheel set, following passage through the transition zone, must be borne by the heel-side frog. In addition, the heel-side frog in a preferred embodiment of the present invention may be made using a simpler geometry than that used in larger heel-side frogs of the prior art. Accordingly, the present invention allows one to minimize the size of the heel-side frog casting, as well as make the heel-side frog easier and less expensive to machine.

The present invention also includes a frog panel system which may be assembled as a complete unit at a manufacturing site and transported to its intended installation site. This allows for greater control manufacturing costs and allows the operator to obtain a completed switch panel that may be produced using a single frog casting, and one that can be installed.

In operation, the system of the present invention also provides for unbroken wheel path that is substantially horizontal wheel path and that is not interrupted by wheel to rail interface.

Frog panel systems of the present invention may be incorporated with canted rail systems that allow for speeds as high as 50-60 mph where desirable.

The several aspects of the present invention may be summarized as follows.

Frog Panel with Angled Rails with Vertical Angled Rails

The present invention includes a frog panel for accommodating the rolling of a railcar wheel of a train wheel set, having a flange and a tread surface and the railcar wheel, when first manufactured, having an original tread-flange distance, across a crossing point from main line rails to turn out rails, the frog panel comprising: (a) a pair of main line rails comprising an outer main line rail and an inner main line rail having a crown; (b) a pair of turn out side rails comprising an outer turn out side rail and an inner turn out side rail; (c) a plurality of railroad ties adapted to support the main line rails and the turn out side rails; wherein the inner main line rail having a continuous beam, the main line rail having a main rail tread bearing surface defining a transition zone thereabove; the inner side rail supported by the ties and crossing the inner main rail, the inner side rail being divided into a toe rail segment and a heel rail segment that are located on opposite sides of the inner main rail; the toe rail segment angled upwardly from the horizontal toward the main rail and terminating at a height such that a flange of a railcar wheel passing through the transition zone will clear the tread bearing surface; and (d) a frog on the heel side of the main rail, the frog having a frog tread bearing surface disposed at a level higher than the inner main rail crown, and being aligned with and secured to the heel rail segment, the heel rail segment angled upwardly from the horizontal toward the frog, the frog having a flange pathway having transitional flangeway floor having an upfield portion substantially level with the crown of the inner main rail, and a downwardly receding downfield portion, such that the flange of a railcar wheel of a train wheel set passing therethrough contacts the transitional flangeway floor prior to the tread of the wheel contacting the frog tread bearing surface.

It is preferred that the inner and outer main rails are canted toward one another, and that the frog is shaped so as to accommodate the main rail cant angle. The heel rail segment may also be is canted and wherein the frog tread bearing surface is disposed at an angle so as to accommodate the canting of the heel rail segment.

It is preferred that the frog tread bearing surface is flat substantially along its longitudinal axis to provide for a smooth run of the wheel through the transition zone. That is, the vertical lift of the crossing wheels is brought about by a vertical bend in the toe side rails, such that the wheels are lifted to a height at which they may cross over while running horizontally through the portion of the transition zone defined by the frog's running length.

Another aspect to the system of the present invention is that the system need include no toe-side frog portion adjacent the toe rail segment.

It is also preferred that the toe rail segment additionally comprises a wing rail portion disposed substantially parallel to the main rail, to assist in maintaining the wheels travelling along the main line in secure alignment, as well as to reduce wear on the frog itself.

It is also preferred that the outer turn out side rail have a leading portion opposite the toe rail segment and angled upwardly from the horizontal in accordance with the upward angle of the toe rail segment, and a trailing portion opposite the heel rail segment and angled downwardly from the horizontal in accordance with the downward angle of the heel rail segment away from the main rail, and further comprising a guard rail disposed along one side of the outer side rail for retaining a train in a proper lateral position with respect to the frog. Such a system has the advantage of featuring a frog that is easier to machine as it requires less complex shaping and machining of channels and flangeways.

The system may preferably be produced by incorporating a plurality of railroad ties having a series of at least two ties disposed beneath the leading portion of the outer side rail, the series of ties being provided with respective riser plates adapted to maintain the leading portion of the outer side rail angled from the horizontal, and the plurality of railroad ties also having a series of at least two ties disposed beneath the trailing portion of the outer side rail, the series of ties being provided with respective riser plates adapted to maintain the trailing portion of the outer side rail angled from the horizontal. The riser system allows vertical bends to be incorporated into the toe and heel side turn out rail portions, as well as to maintain the wheel sets in a substantially horizontal run line through the transition zone.

The frog preferably comprises a base surface and a tread bearing surface, the frog tread bearing surface being flat substantially along its longitudinal axis, and the base surface adapted to maintain the frog tread bearing surface substantially horizontal when the base surface is placed upon a flat supporting surface, the frog additionally comprising a first and second flange way at a horizontal angle to one another, the first flange way provided with a downwardly angled flange-bearing bottom surface having an entry point, the difference between the height of the frog tread bearing surface and the height of the entry point being greater than the original tread-flange distance.

Frog Panel Angled Rails with Risers

In a preferred embodiment, the invention includes a frog panel for accommodating the rolling of a railcar wheel of a train wheel set, having a flange and a tread surface, and the railcar wheel, when first manufactured, having an original tread-flange distance, across a crossing point from main line rails to turn out rails, the main line rails to turn out rails having a toe end side and a heel end side, the frog panel comprising: (a) a pair of main line rails comprising an outer main line rail and an inner main line rail; (b) a pair of turn out side rails comprising an outer side rail and an inner side rail; (c) a plurality of railroad ties adapted to support the main line rails and the turn out rails; the inner main rail having a continuous beam, the main rail having a main rail tread bearing surface defining a transition zone thereabove; the inner side rail supported by the ties and crossing the inner main rail, the inner side rail being divided into a toe rail segment and a heel rail segment that are located on opposite sides of the inner main rail; the toe rail segment angled upwardly from the horizontal toward the main rail and terminating at a height such that a flange of a railcar wheel passing through the transition zone will clear the tread bearing surface; and (d) a frog on the heel side of the main rail, the frog having a frog tread bearing surface disposed at a level higher than the inner main rail crown, and being aligned with and secured to the heel rail segment, the heel rail segment angled upwardly from the horizontal toward the frog, the frog having a flange pathway having transitional flangeway floor having an upfield portion substantially level with the crown of the inner main rail, and a downwardly receding downfield portion, such that the flange of a railcar wheel of a train wheel set passing therethrough contacts the transitional flangeway floor prior to the tread of the wheel contacting the frog tread bearing surface; the plurality of railroad ties having a series of at least two ties disposed beneath the toe rail segment, the series of ties being provided with respective riser plates adapted to maintain the toe rail segment angled upwardly from the horizontal toward the main rail; and the plurality of railroad ties having a series of at least two ties disposed beneath the heel rail segment, the series of ties being provided with respective riser plates adapted to maintain the heel rail segment angled upwardly from the horizontal toward the frog.

It is most preferred that the inner and outer main rails are canted toward one another, and wherein the plurality of railroad ties have a series of at least two ties disposed respectively beneath the inner and outer main rails, the at least two ties being provided with respective riser plates that are adapted to maintain the inner and outer main rails in a canted position. Most preferably, the heel rail segment is canted and wherein the frog tread bearing surface is disposed at an angle so as to accommodate the canting of the heel rail segment.

In a preferred embodiment, the frog tread bearing surface is flat substantially along its longitudinal axis.

This system may be constructed with the toe rail segment having no toe-side frog portion adjacent thereto.

The toe rail segment may additionally and preferably comprise a wing rail portion disposed substantially parallel to said main rail.

The outer side rail preferably will have a leading portion opposite the toe rail segment and angled upwardly from the horizontal in accordance with the upward angle of the toe rail segment, and a trailing portion opposite the heel rail segment and angled downwardly from the horizontal in accordance with the downward angle of the heel rail segment away from the main rail. This arrangement will further include a corresponding guard rail disposed along one side of the outer side rail for retaining a train wheel set in a proper lateral position with respect to the frog, the guard rail comprising a leading portion adjacent the leading portion of the outer side rail and angled upwardly from the horizontal in accordance with the upward angle of the leading portion of the outer side rail, and a trailing portion adjacent the trailing portion of the outer side rail and angled downwardly from the horizontal in accordance with the downward angle of the trailing portion of the outer side rail.

The plurality of railroad ties normally will feature a series of at least two ties disposed beneath the leading portion of the outer side rail, the series of ties being provided with respective riser plates adapted to maintain the leading portion of the outer side rail angled from the horizontal up to the transition point to raise the wheel on the turn out side on-coming wheel set to a height approximately equal to that of the crossing wheel as it passes over the main line rail. Likewise, the plurality of railroad ties also has a series of at least two ties disposed beneath the trailing portion of the outer side rail, the series of ties being provided with respective riser plates adapted to maintain the trailing portion of the outer side rail angled from the horizontal, so as to allow the turn out side departing wheel to be returned to its original running elevation.

It is also preferred that the frog comprise a base surface and a tread bearing surface, such that the frog tread bearing surface is flat substantially along its longitudinal axis, and the base surface adapted to maintain the frog tread bearing surface substantially horizontal when the base surface is placed upon a flat supporting surface, the frog additionally comprising a first and second flange way at a horizontal angle to one another, the first flange way provided with a downwardly angled bottom surface having an entry point, the difference between the height of the frog tread bearing surface and the height of the entry point being greater than the original tread-flange distance.

Basic Main Rail/Side Rail Intersection Panel

The present invention also includes a system for crossing a train on a side track over a main track, the system comprising: (a) a plurality of railroad ties; (b) a main rail having a continuous beam supported by the ties, the main rail having a main rail tread bearing surface; (c) a turnout side rail section supported by the ties and crossing the main rail, the side rail section being divided into a toe rail segment and a heel rail segment that are located on opposite sides of the main rail; the toe rail segment angled upwardly from the horizontal toward the main rail and terminating at a height; and (d) a frog on the heel side of the main rail, the frog having a frog tread bearing surface disposed at a level higher than inner main rail crown, and being aligned with and secured to the heel rail segment, the heel rail segment angled upwardly from the horizontal toward the frog, the frog having a flange pathway having transitional flangeway floor having an upfield portion substantially level with the crown of the inner main rail, and a downwardly receding downfield portion, such that the flange of a railcar wheel of a train wheel set passing therethrough contacts the transitional flangeway floor prior to the tread of the wheel contacting the frog tread bearing surface the frog having a frog tread bearing surface disposed at a level higher than the main rail tread bearing surface, and being aligned with and secured to the heel rail segment, the heel rail segment angled upwardly from the horizontal toward the frog.

Preferably, the plurality of railroad ties having a series of at least two ties disposed beneath the toe rail segment, the series of ties being provided with respective riser plates adapted to maintain the toe rail segment angled upwardly from the horizontal toward the main rail.

Likewise, the plurality of railroad ties preferably have a series of at least two ties disposed beneath the heel rail segment, the series of ties being provided with respective riser plates adapted to maintain the heel rail segment angled upwardly from the horizontal toward the frog.

It is also preferred that the main rail is canted, and that the plurality of railroad ties have a series of at least two ties disposed beneath the main rail, the at least two ties being provided with respective riser plates that are adapted to maintain the main rail in a canted position. Optionally, the heel rail segment may be canted and wherein the frog tread bearing surface is disposed at an angle so as to accommodate the canting of the heel rail segment.

The preferred system features a toe rail segment additionally comprising a rail portion disposed substantially parallel to the main rail.

It is also preferred that the outside turn out rail has a leading portion opposite the toe rail segment and angled upwardly from the horizontal in accordance with the upward angle of the toe rail segment, and a trailing portion opposite the heel rail segment and angled downwardly from the horizontal in accordance with the downward angle of the heel rail segment away from the main rail, and further comprising a guard rail disposed along one side of the outside turn out side rail for retaining a train in a proper lateral position with respect to the frog.

Basic Main Rail/Side Rail Intersection Arrangement

The present invention also includes a fundamental rail arrangement for crossing a railcar wheel of a train wheel set on a side track over a main track, the system comprising: (a) a main rail having a continuous beam, the main rail having a main rail tread bearing surface; (b) a turnout side rail supported by the ties and crossing the main rail, the turnout side rail being divided into a toe rail segment and a heel rail segment that are located on opposite sides of the main rail; the toe rail segment angled upwardly from the horizontal toward the main rail and extending to a height sufficient to lift a rolling train wheel to a height sufficient to allow it to pass over the main rail, the toe rail segment having no toe-side frog portion associated therewith; and (c) a frog on the heel side of the main rail, the frog having a frog tread bearing surface disposed at a level higher than the crown of the inner main rail, and being aligned with and secured to the heel rail segment, the heel rail segment angled upwardly from the horizontal toward the frog, the frog having a flange pathway having transitional flangeway floor having an upfield portion substantially level with the crown of the inner main rail, and a downwardly receding downfield portion, such that the flange of a railcar wheel of a train wheel set passing therethrough contacts the transitional flangeway floor prior to the tread of the wheel contacting the frog tread bearing surface, the frog having a frog tread bearing surface disposed at a level higher than the main rail tread bearing surface, and being aligned with and secured to the heel rail segment, the heel rail segment angled upwardly from the horizontal toward the frog. For higher speed applications, the heel rail segment is canted and the frog tread bearing surface is disposed at an angle so as to accommodate the canting of the heel rail segment. Likewise, the toe rail segment additionally comprises a rail portion disposed substantially parallel to the main rail.

Frog Casting

Yet another fundamental aspect of the present invention is a frog casting for guiding a railcar wheel of a train wheel set on a turn out side rail over a main rail in intersecting alignment therewith, the train wheel, when first manufactured, having an original tread-flange distance, the frog comprising a base surface and a tread bearing surface, the frog tread bearing surface being flat substantially along its longitudinal axis, and the base surface adapted to maintain the frog tread bearing surface substantially horizontal when the base surface is placed upon a flat supporting surface, the frog additionally comprising a first and second flange way at a horizontal angle to one another, the first flange way provided with a downwardly angled bottom surface having an entry point, the difference between the height of the frog tread bearing surface and the height of the entry point being greater than the original tread-flange distance. It is most preferred that this distance is in the range of from about 1.20 to about 1.35 inches, so as to accommodate both relatively newer rail wheels as well as those whose flange-tread height has been lengthened through wear.

It will be understood that all disclosed features of the present invention may be utilized to the extent that they are not logically inconsistent with one another.

DETAILED DESCRIPTION OF THE PREFERRED EMBODIMENTS

Figure 1:
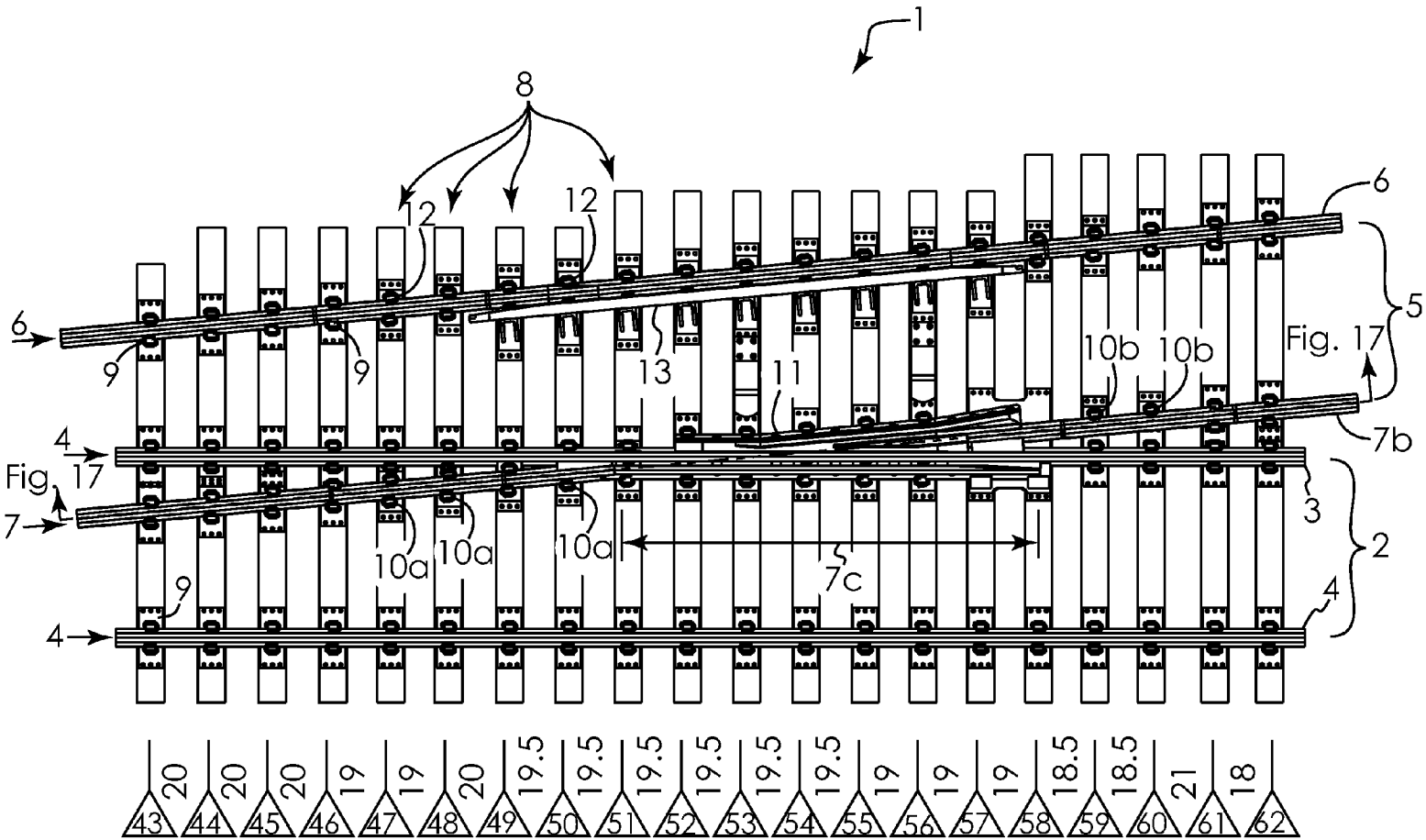
FIG. 1 is a plan view of the arrangement of the rails of a railroad switch turnout panel assembly, in accordance with one embodiment of the present invention.

In accordance with the foregoing summary, the following describes a preferred embodiment of the present invention which is considered to be the best mode thereof. With reference to the drawings, the invention will now be described in detail with regard for the best mode and preferred embodiment.

FIGS. 1-21 show, using like reference numerals, a frog and rail track assembly in accordance with one embodiment of the present invention.

The following patent documents generally describe frog and rail systems with which the present invention may be used, and such references are hereby incorporated herein by reference:

| | |
|---|---|
| 7,377,471 | Method and system for opening and securing a railroad frog |
| 7,121,513 | Cross frog for a set of track points, provided with an end of position-retaining device |
| 7,083,149 | Cross frog |
| 6,994,299 | Railroad crossing apparatus having improved rail connection and improved flangeway floor geometry and method incorporating the same |
| 6,732,980 | Railway frog wear component |
| 6,543,728 | Cross frog |
| 6,340,140 | Railroad frog for switch points and crossings |
| 6,286,791 | Railroad spring wing frog with hold-open and shock dampening elements |
| 6,276,642 | Railroad spring wing frog assembly |
| 6,266,866 | Frog insert and assembly and method for making frog assembly |
| 6,224,023 | Railroad spring frog assembly |
| 6,177,205 | Process for producing a permanent way component and such a component |
| 6,164,602 | Railroad frog assembly with multi-position holdback |
| 6,158,697 | Railroad frog assembly with latch holdback |
| 6,138,958 | Spring rail frog |
| 5,810,298 | Railroad spring frog assembly |
| 5,806,810 | Spring rail frog having switchable magnet for holding wing rail open |
| 5,782,437 | Spring rail frog having bendable rail with modified cross-section |
| 5,743,496 | Railroad frog crossing bolt and nut assembly for clamping railroad rail sections together |
| 5,598,993 | Pseudo heavy point frog assembly |
| 5,595,361 | Wing rail hold-down |
| 5,560,571 | Reversible wing insert frog |
| 5,544,848 | Railroad spring frog |
| 5,531,409 | Flange bearing bolted rail frog for railroad turnouts and crossings |
| 5,522,570 | Rail section |
| 5,375,797 | Compound geometry rail switch |
| 5,184,791 | Frog tip that can be shifted relative to the wing rails |
| 5,082,214 | Crossing frog with a moving point |
| 5,042,755 | Process for producing a crossing frog with a moving point |
| 4,982,919 | Reversing device for movable parts of a railway switch |
| 4,953,814 | Railway switch comprising a frog having a movable main point and auxiliary point |
| 4,948,073 | Turnout with closing frog |
| 4,908,993 | Grinding machine for reprofiling railheads |
| 4,756,477 | Plate for supporting railway rails and a track assembly using it |
| 4,637,578 | Railroad frog having movable wing rails |
| 4,624,428 | Spring rail frog |
| 4,589,617 | Frog for switches |
| 4,516,504 | Cross-over track structure for wheeled pallets |
| 4,514,235 | Frog, in particular frog point, for rail crossing or rail switches as well as process for producing same |
| 4,469,299 | Railway turnouts |
| 4,169,745 | Method of joining frogs of wear-resisting manganese steel castings to rails of carbon steel |
| 4,168,817 | Rail switch |
| 4,159,090 | Railway switch for vignoles rails |
| 4,144,442 | Process for producing a component part of a railway switch or a railway crossing and component part of railway switches or railway crossings produced by such process |

-continued

| | |
|---|---|
| 4,015,805 | Railway switch or railway crossing |
| 20100270436 | ADJUSTMENT DEVICE IN RAILROAD SWITCHES |
| 20070007394 | System, method, and apparatus for railroad turnout and derail lift frog |
| 20060202047 | Use of k-spiral, bend, jog, and wiggle shapes in design of railroad track turnouts and crossovers |
| 20050145754 | Cross frog |
| 20050067535 | Cross frog for a set of track points, provided with an end of position-retaining device |
| 20040124316 | Railroad crossing apparatus having improved rail connection and improved flangeway floor geometry and method incorporating the same |
| 20040065784 | Railway frog wear component |

FIG. 1 is a plan view of the arrangement of the rails of a railroad switch turnout panel in accordance with the preferred embodiment of the present invention.

FIG. 1 shows a main line rail set 2 comprising an inner main line rail 3 (i.e. that disposed on the turnout side) and an outer main line rail 4 (i.e. that disposed opposite the turnout side). FIG. 1 also shows a turn-out rail set 5 comprising an inner turn-out line rail 7 (i.e. that disposed on the turnout side) and an outer turn-out line rail 6 (i.e. that disposed opposite the turnout side). FIG. 1 shows a frog layout used at the intersection of the inner main line rail 3 and the inner turn-out line rail 7 which is divided into a toe side portion 7*a* and a heel side portion 7*b*. The upstream side of the panel (i.e., to the left of that intersection) is referred to as the "toe" side and the downstream side of the panel (i.e., to the right of that intersection) is referred to as the "heel" side.

The main line rail set 2 are supported on a series of ties 8 and typically will be maintained level with the supporting ballast bed, which typically will be horizontal in the area where the panel 1 is laid. The ties are designated as positions 43-62, and the rails are affixed by corresponding plates, such as plates 9.

FIG. 1 also shows the position of frog casting 11.

The main line rails 3 and 4 are maintained in a level, horizontal position through the panel region.

In contrast, the rails comprised by the proceeding from the toe side to the heel side, the toe side portion 7*a* and a heel side portion 7*b* of the inner turnout rail 7 are provided with a vertical incline that is, in the preferred embodiment, brought about by the inclusion of risers 10*a* and 10*b*. Riser plates 10*a* that provide a vertical incline to the portion of the toe side portion 7*a*, rising toward frog the transition region (where the crossing wheel proceeds over the inner main line rail 3). Riser plates 10*b* provide a vertical incline to the portion of the heel side portion 7*b*, descending away from frog 11 after the crossing wheel proceeds over it; i.e. downstream of the transition zone.

Likewise, the outer turn-out line rail 6 is supported by riser plates such as riser plates 12 that provide a vertical incline from approximately tie position 49 to approximately the transition zone in the region of ties 54 and 55 maintaining outer turn-out line rail 6 at approximately and consistently the same height as the corresponding portions of the toe side portion 7*a* of inner turn out rail 7. The relatively downstream portion of outer turn-out rail 6 is then provided with a downward incline by virtue of the provision of riser plates on high positions 57 through 59 so as to provide a vertical decline assistant with the vertical decline of heel side portion 7*b* of turn-out rail 7. By including risers of this type, or any other equivalent mechanical arrangement, such as the use of specially-dimensioned ties that might be formed of concrete or other material, the arrangement of the present invention provides for substantially co-plainer vertical bends in the outer turn-out rail 6 and the toe side portion 7*a* of inner turn-out rail 7 in advance of the wing rail portion 7*c* of inner turn-out rail 7. The wing rail portion 7*c* is maintained at an elevated height compared to the base rail height so as to provide a "guard/check" rail through the frog transition zone which in turn protects the frog casting from excessive contact.

Correspondingly, the arrangement of the present invention also provides for substantially coplanar vertical descending bends in the heel side portion 7*b* of inner turn-out rail 7 and the corresponding and opposed portion of outer turn-out rail 6. The portions of outer turn-out rail 6 and the opposed portion of the frog 11 are provided with riser plates or similar mechanical support that maintain the portions of outer turn-out rail 6 and frog 11 at approximately tie positions 52 through 58 substantially level and coplanar with one another. The same is true of guard rail 13 which serves to maintain the outer wheel in its path through the switch. The guard rail 13 is also shaped so as to follow the vertical rise and descent of the outer turn-out rail 6.

Figure 2:
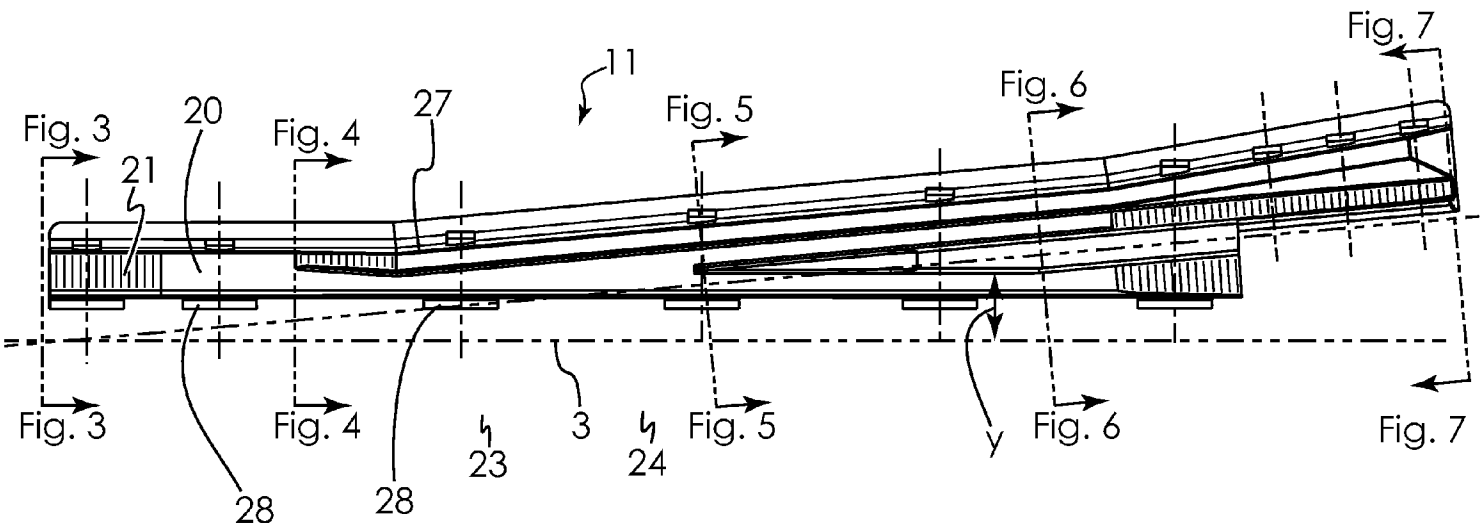
FIG. 2 is a plan view of a frog used in accordance with a railroad switch turnout panel assembly, in accordance with one embodiment of the present invention.

FIG. 2 is a plan view of a frog 11 used in accordance with railroad a switch turn-out panel assembly, in accordance with the preferred embodiment of the present invention. FIG. 2 shows frog 11 that is placed on the turn-out side of main rail 3, and that the rail head or crown of main line 3 runs alongside. Frog 11 features flange way floor 20 which has a sloped surface 21. This view also shows the intersection of the turn-out side gauge line 22 and the main line gauge line 23 in the layout of the panel assembly. The flange way floor 20 extends essentially horizontally so as to engage and capture the flange of the railroad wheel 24 as it is elevated by the vertical bend in the toe side portion 7*a* of inner turn-out rail 7. The flange of wheel 24 is supported by the flange way floor 20 as the wheel moves along the turnout route through the transition zone to a point where the elevated tread-bearing portion 25 of frog 11 encounters the tread surface of wheel 24. This lateral movement cross-distance "y" is the distance required for wheel tread clearance, with the tread-bearing surface increasing to a width approximately equivalent to the "y" intersection. FIG. 2 also generally shows the transition zone 26 with positional indications showing that relatively newer wheels will tend to transfer from the flange-bearing surface of flange way floor 20 to the tread-bearing surface 25 relatively earlier in the transition zone owing to the relatively shorter flange-tread height of unworn wheels. This may be accommodated by the use of a sloped floor in tread-bearing surface 25 provided the entry of the transition zone 26. By contrast, wheels having been subjected to average wear will transition from flange-bearing to tread-bearing in the central part of the transition zone while fully-worn wheels tend to transfer from a flange-supported condition to a tread-supported condition relatively downstream in the transition zone. The frog design of the present invention accommodates even severely worn wheels that will remain in a flange-bearing condition until deep into the transition zone. The frog of the present invention preferably includes a sloped, declining surface of flange way floor 20.

The frog 11 also features elevated guard portion 27 that assists in maintaining the transitioning wheel in proper alignment with respect to its intended direction of travel toward the heel side portion 7*b* of the inner turn-out rail 7.

The frog 11 also preferably features rail fit pad portions 28 that are designed to accept a canted main line rail 3. The frog 11 may also preferably include a sloped portion 29 that is designed to accommodate an encounter with an excessively worn wheel that presents a so-called "false flange" as a result of excessive wear.

It is also preferred that the downstream-sloped portion of flange way floor 20 be flared at its opening as shown in order to accommodate wheel movement through the balance of the transition zone, to allow the wheel to be returned to a tread-bearing condition.

The railway switch panel assembly of the present invention thus provides an elevated track-bearing surface adapted to accept the tread of a railway wheel as it is made to rise vertically by the vertically-bent toe side portion 7*a* of inner turn-out rail 7 to have its flange engaged and captured, thus allowing the wheel to be guided through a smooth transition to a tread-bearing condition as the flange way floor declines in the downstream portion of the transition zone.

Figure 3:
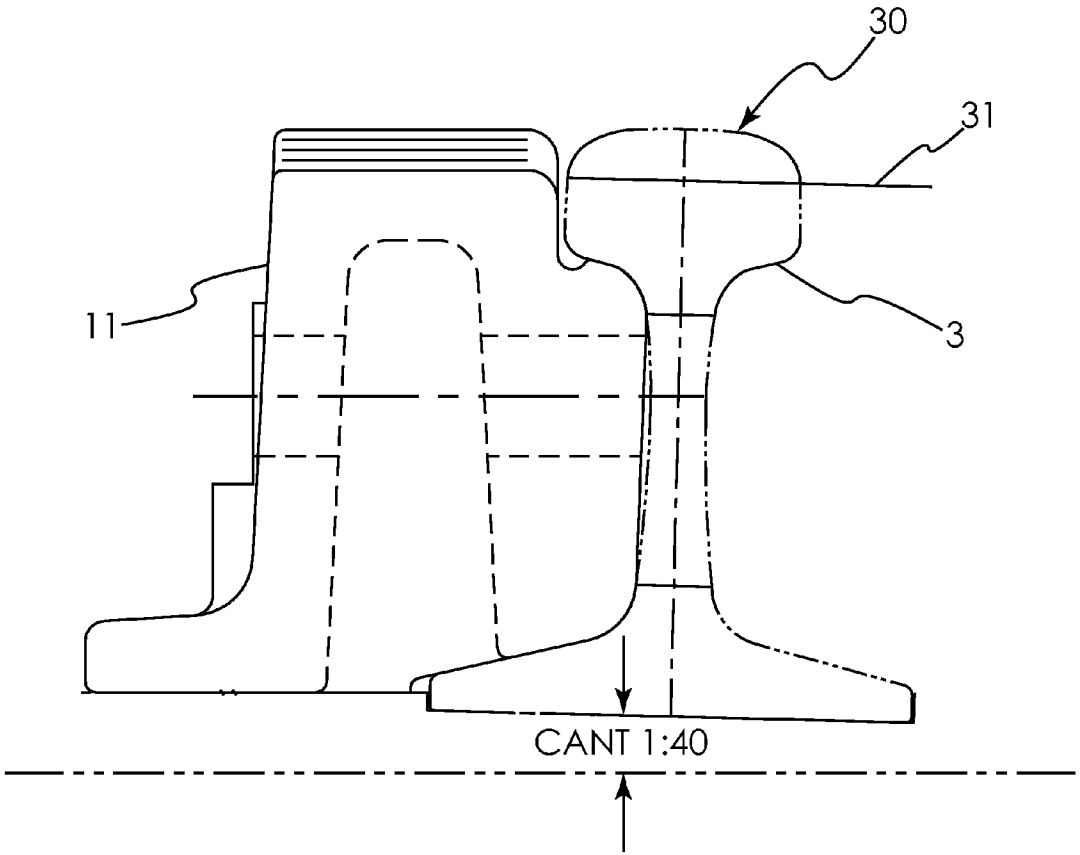
FIG. 3 is a cross-section view of a frog and mainline rail used in accordance with a railroad switch turnout panel assembly, in accordance with one embodiment of the present invention.

FIG. 3 is an end-view of frog 11 shown alongside sectioned main rail 3 having crown 30. This view also shows the sloped portion 21 of flange way floor 20. FIG. 3 is a view along line A-A of FIG. 2. FIG. 3 also shows the false flange slope and its relative position to the crown 30 of main line rail 3. This also shows main line gage line 31. This view also shows how frog 11 is shaped to fit against main line 3 to accommodate the cant angle as is preferred in the present invention. It will be appreciated from these cross-sections that the principal part of the flangeway floor 20 that initially accepts and guides the wheel flange is substantially horizontal through its length of travel (with the exception of the descending downstream flangeway floor portion). It is likewise preferred that the base of the frog 11 is likewise horizontal. Along its length.

Figure 4:
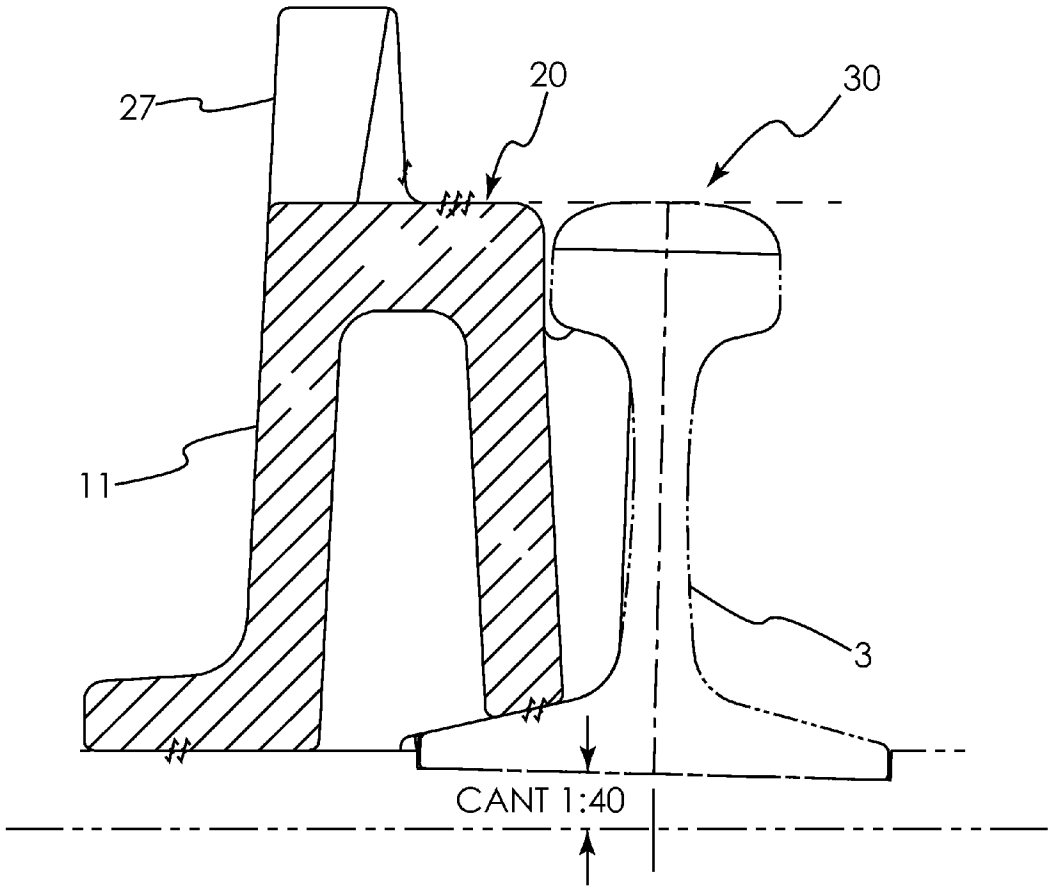
FIG. 4 is a cross-section view of a frog and mainline rail used in accordance with a railroad switch turnout panel assembly, in accordance with one embodiment of the present invention.

FIG. 4 is a cross-sectional view taken along line B-B of FIG. 2. This view shows the position of main line rail 3 and the relative height of crown 30 to flange way floor 20. This view also shows the relative position of elevated guard portion 27 of frog 11. This view shows the approximate point at which the turn-out wheel is flange-bearing as it proceeds to cross over the crown 30 of main line rail 3.

Figure 5:
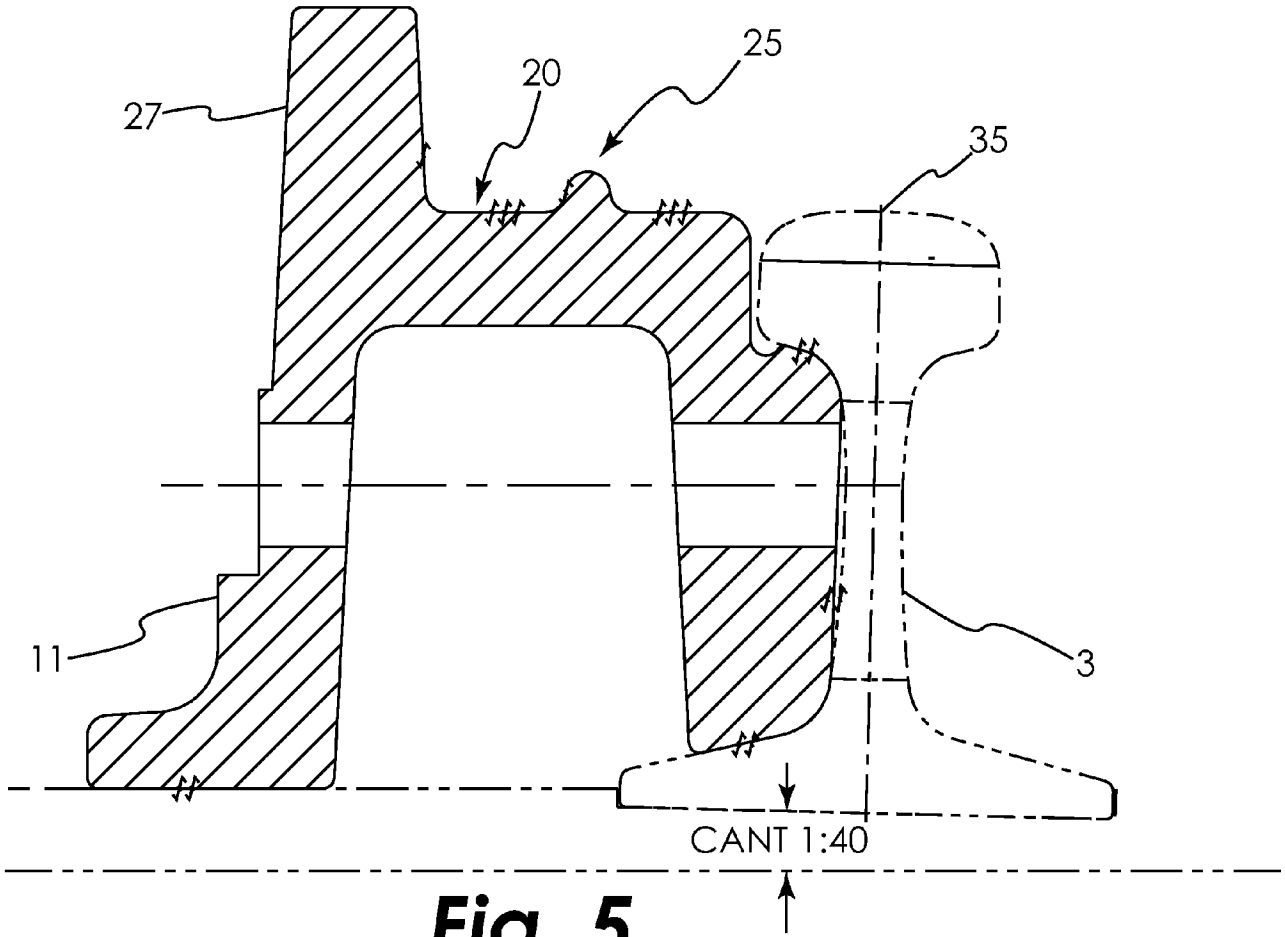
FIG. 5 is a cross-section view of a frog and mainline rail used in accordance with a railroad switch turnout panel assembly, in accordance with one embodiment of the present invention.

FIG. 5 shows a cross-sectional view taken along line C-C of FIG. 2. This view shows frog 11 aside main line rail 3 and its crown 30. Also shown is the position of elevated guard portion 27 and flange way floor 20, as well as the initial sloped portion of the toe side portion of the tread-bearing surface 25. This view shows the start of the transition slope as well as the point at which the turn-out rail is flange-bearing.

Figure 6:
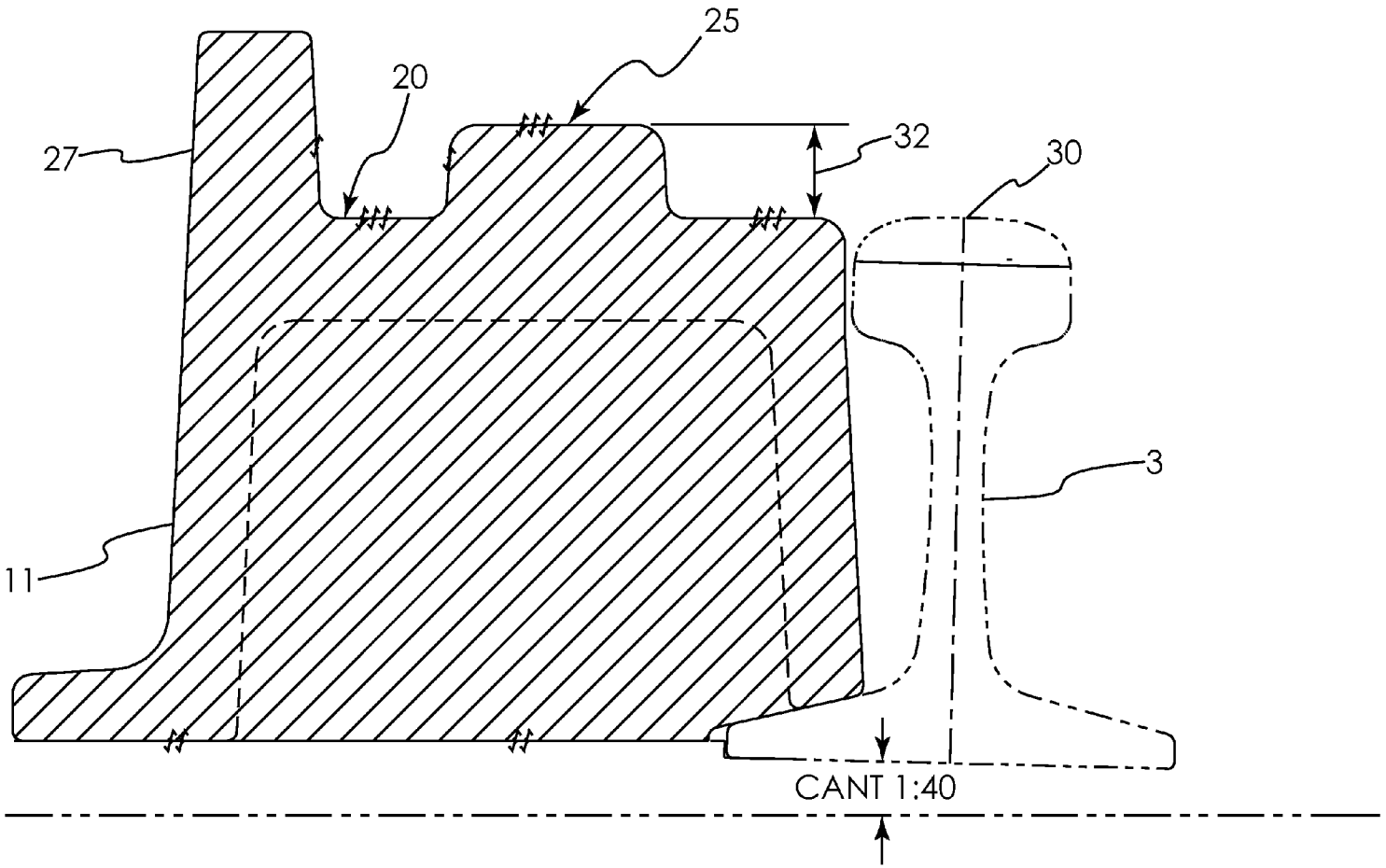
FIG. 6 is a cross-section view of a frog and mainline rail used in accordance with a railroad switch turnout panel assembly, in accordance with one embodiment of the present invention.

FIG. 6 is a cross-section view taken along line D-D of FIG. 2. This view shows the relative position of frog 11 alongside main line rail 3 and its crown 30. This view shows the relative position and height of elevated guard portion 27 as compared to the flange way floor 20 and the fully-level tread-bearing surface 25. This view shows the relative height of the flange way floor 20, tread-bearing surface 25 and main rail crown 30 demonstrating the frog's profile approximately in the center of the transition zone showing the frog's apparent engagement of the rail wheel flange and the beginning of the region of travel wherein the wheel is transitioned to a tread-bearing condition as the flange way floor proceeds toward decline. This view shows the tread-bearing portion of the frog 11 at a point of full railhead width, and shows the according flange height 32. At this point, the elevated wheel is in a tread-bearing condition or in a flange-bearing condition if the flange height is greater than or equal to the provided flange height distance 32.

Figure 7:
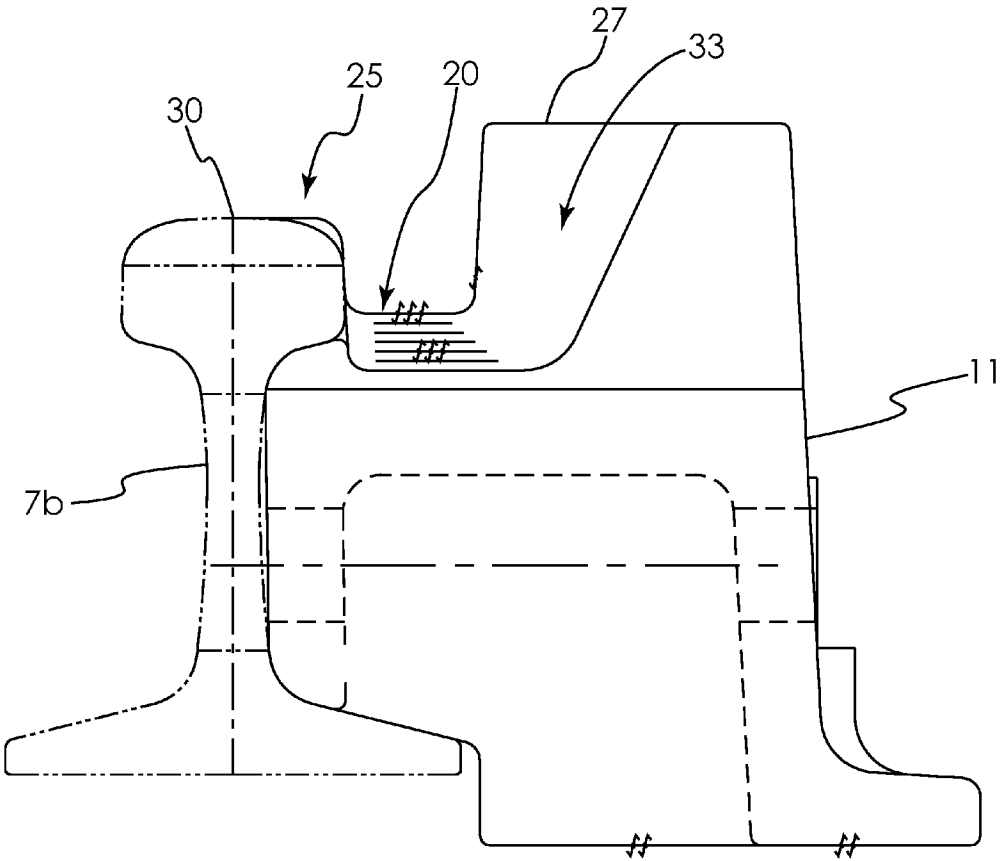
FIG. 7 is a cross-section view of a frog and mainline rail used in accordance with a railroad switch turnout panel assembly, in accordance with one embodiment of the present invention.

FIG. 7 is an end view taken along line E-E of FIG. 2 showing the frog 11 alongside main rail 3 and its crown 30. This view shows the relative position of flange way floor 20 as it begins its declining position along the sloped portion shown. This view also demonstrates that the frog 11 allows the heel side portion 7*b* of turn-out rail 7 to be aligned with the tread-bearing surface to allow the transitioned railway wheel to descend to a level traveling condition following the transition. This view shows the elevated rail fit for the heel rail showing the flared opening 33 along with the entry slope of the descending flange way floor 20.

Figure 8:
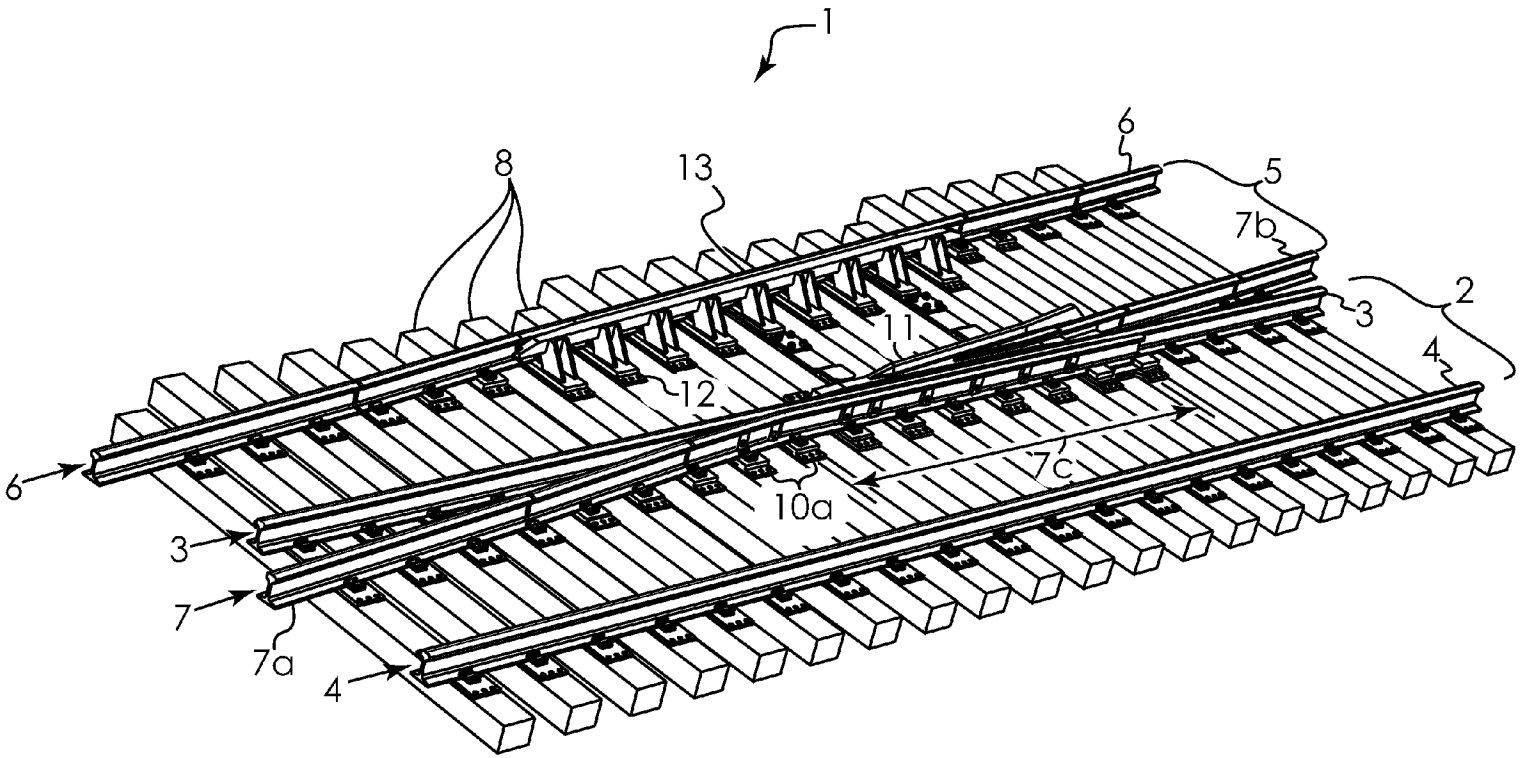
FIG. 8 is an upper toe side perspective view of a railroad switch turnout panel assembly, in accordance with one embodiment of the present invention.

FIG. 8 shows an upper toe-side perspective view of a railroad switch turn-out panel assembly, in which like reference numerals used herein above apply.

Figure 9:
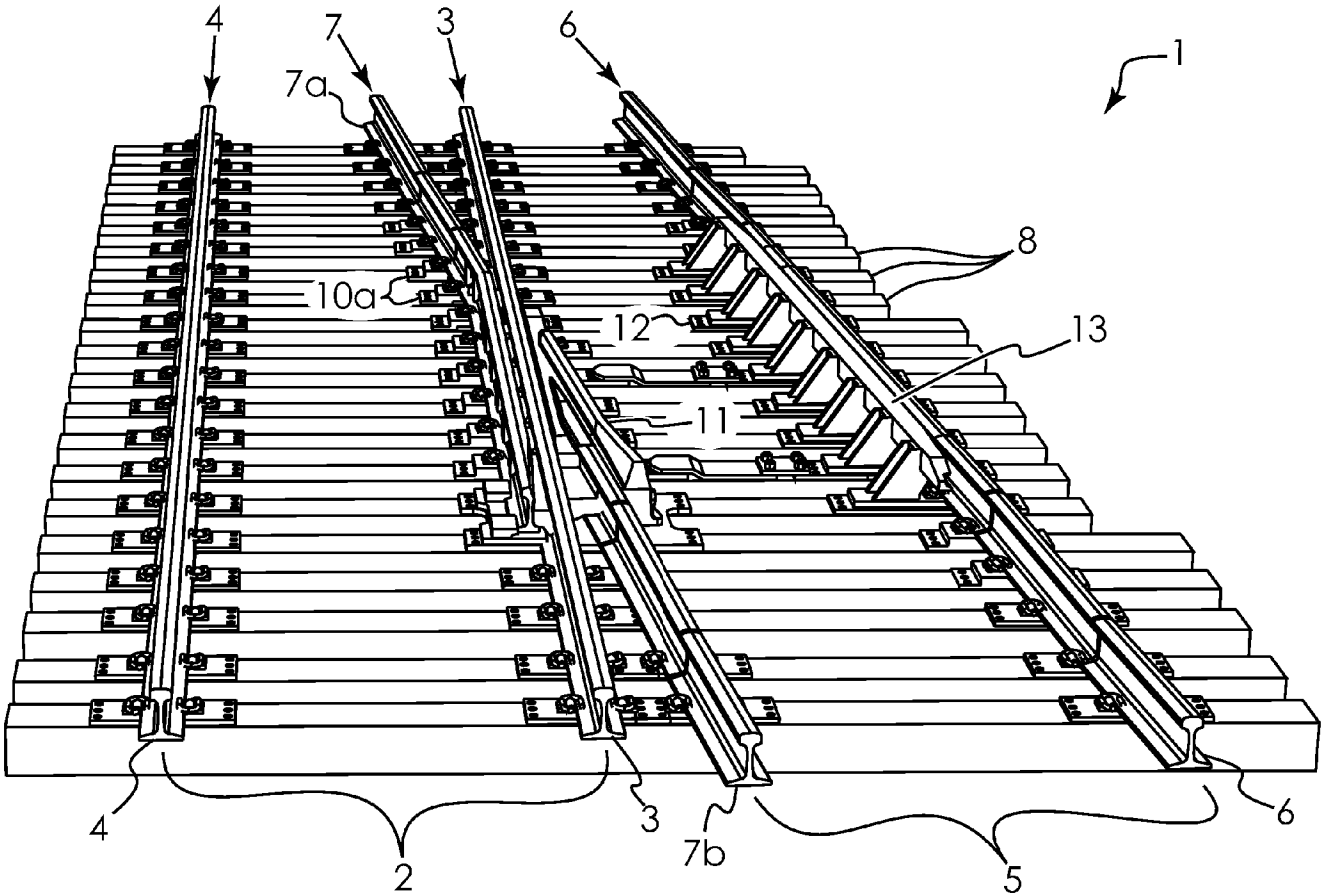
FIG. 9 is an upper heel side perspective view of a railroad switch turnout panel assembly, in accordance with one embodiment of the present invention.

FIG. 9 is an upper heel side perspective view of a railroad switch turn-out panel assembly in accordance with one embodiment of the present invention and in which like numerals herein above apply.

Figure 10:
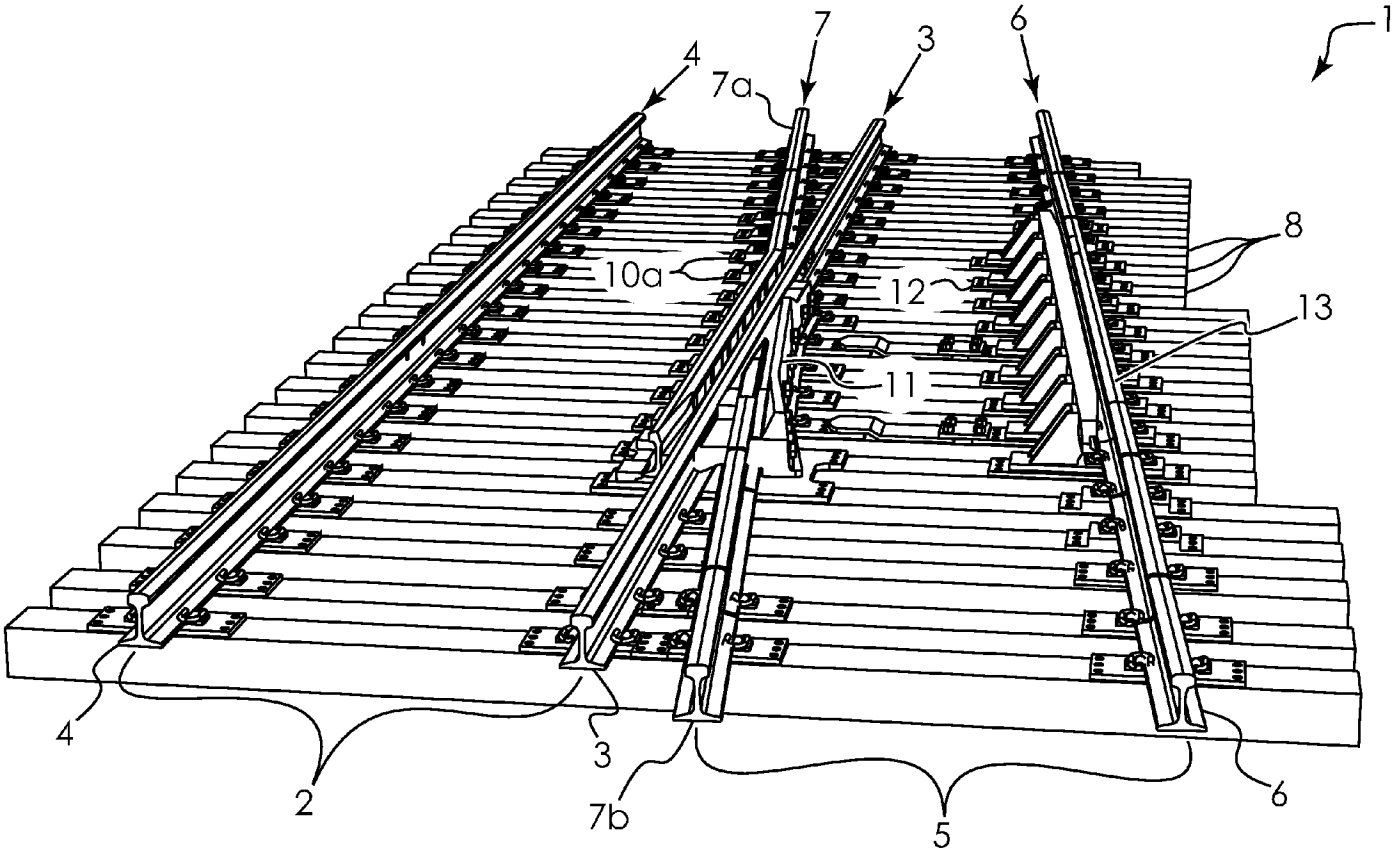
FIG. 10 is an upper heel side perspective view of a railroad switch turnout panel assembly, in accordance with one embodiment of the present invention.

FIG. 10 is another upper heel side perspective view of a railroad switch turnout panel assembly, in which like reference numerals used herein above apply.

Figure 11:
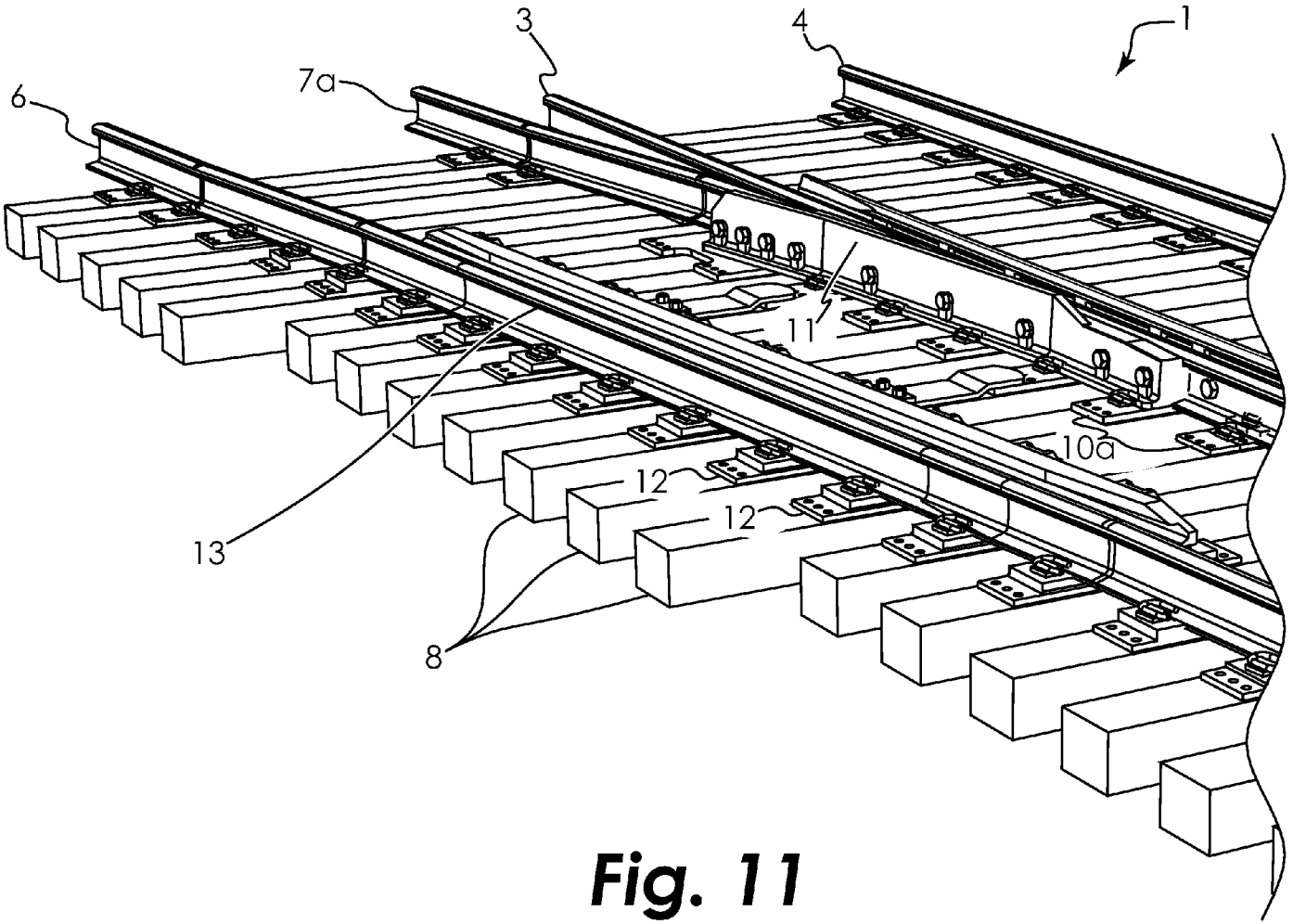
FIG. 11 is a detailed turnout side perspective view of a railroad switch turnout panel assembly, in accordance with one embodiment of the present invention.

FIG. 11 is a detailed turnout side perspective view of a railroad switch turnout panel assembly, in which like reference numerals used herein above apply.

These views show the completed switch panel which may be manufactured and assembled at a manufacturing plant and then transported to the railway site for installation and incorporation into the railway.

Figure 12:
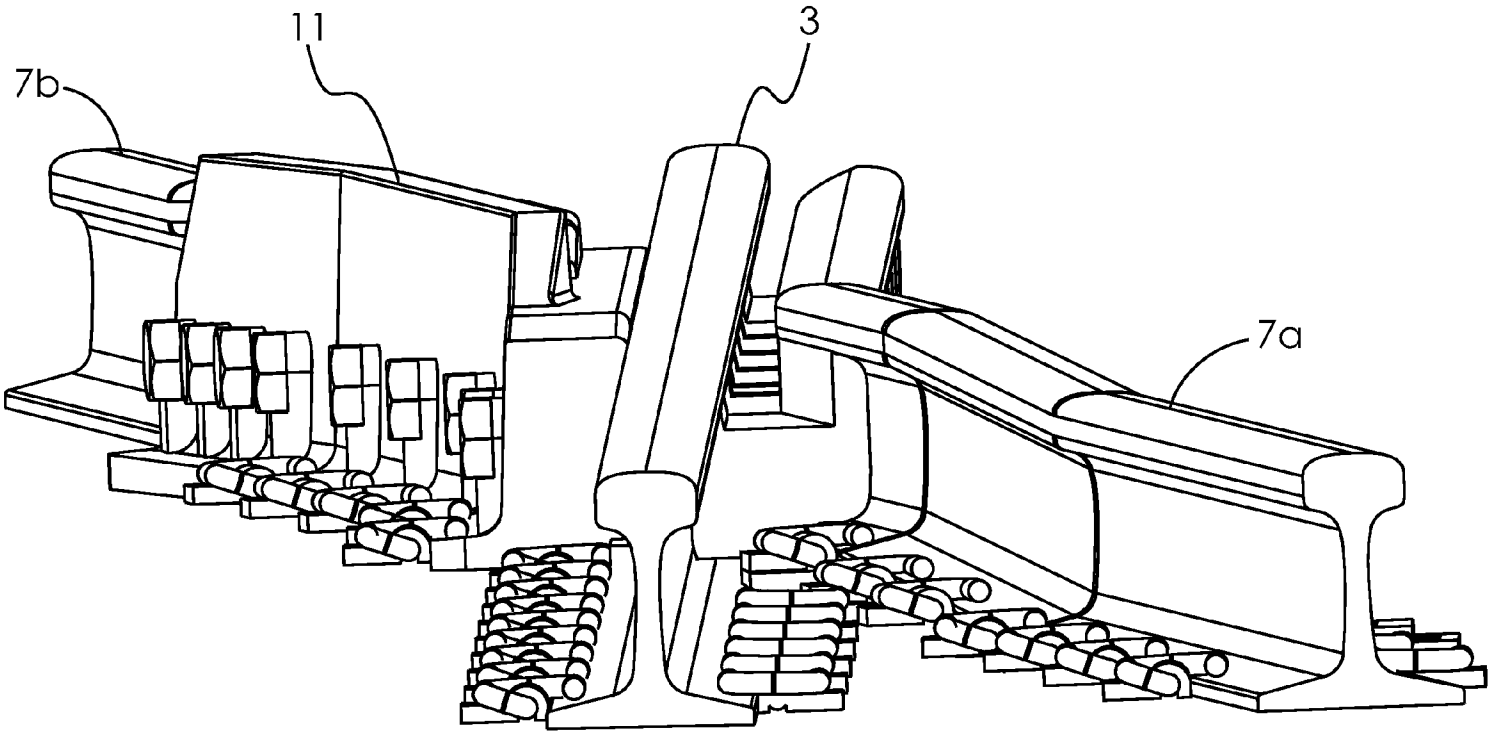
FIG. 12 is a detailed main line run perspective view as it proceeds through a railroad switch turnout panel assembly, in accordance with one embodiment of the present invention.

FIG. 12 is a detailed main line run perspective view as it proceeds through a railroad switch turnout panel assembly, in accordance with one embodiment of the present invention.

Figure 13:
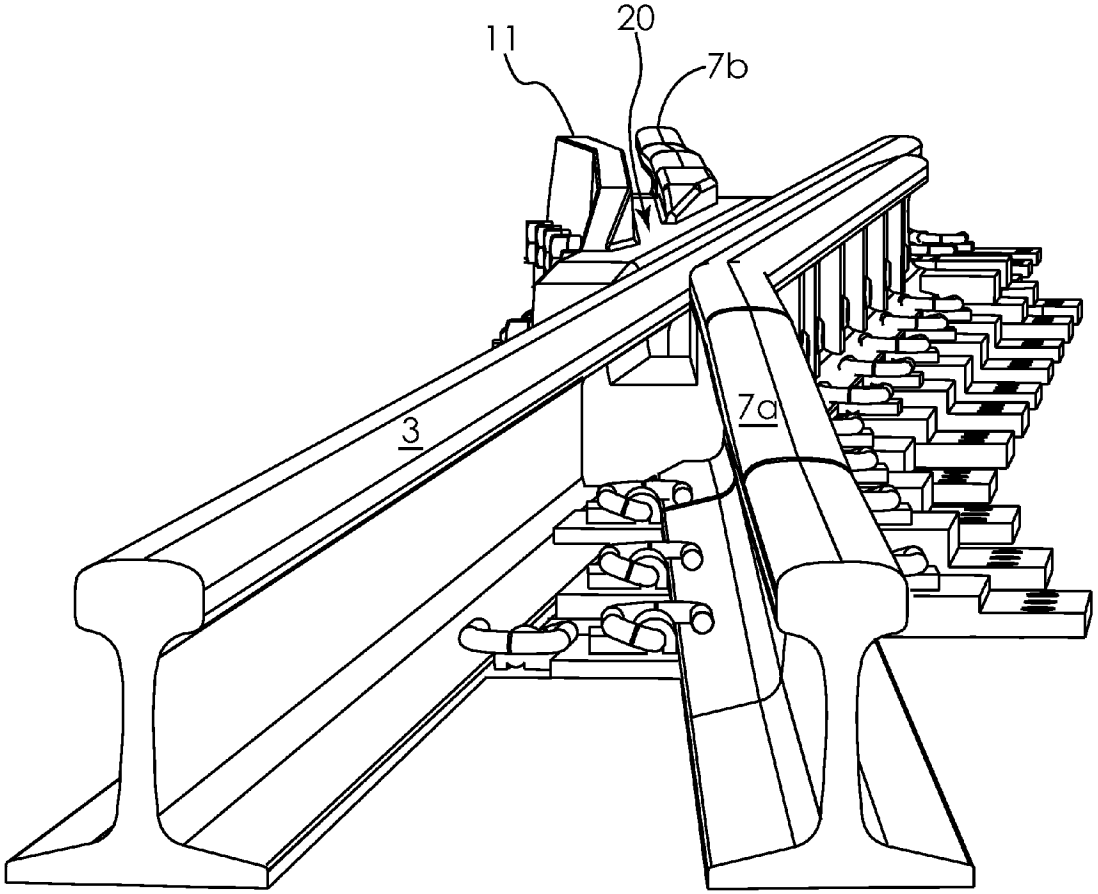
FIG. 13 is a detailed turnout run perspective view as it proceeds through a railroad switch turnout panel assembly, in accordance with one embodiment of the present invention.

FIG. 13 is a detailed turnout run perspective view as it proceeds through a railroad switch turnout panel assembly, in accordance with one embodiment of the present invention.

Figure 14:
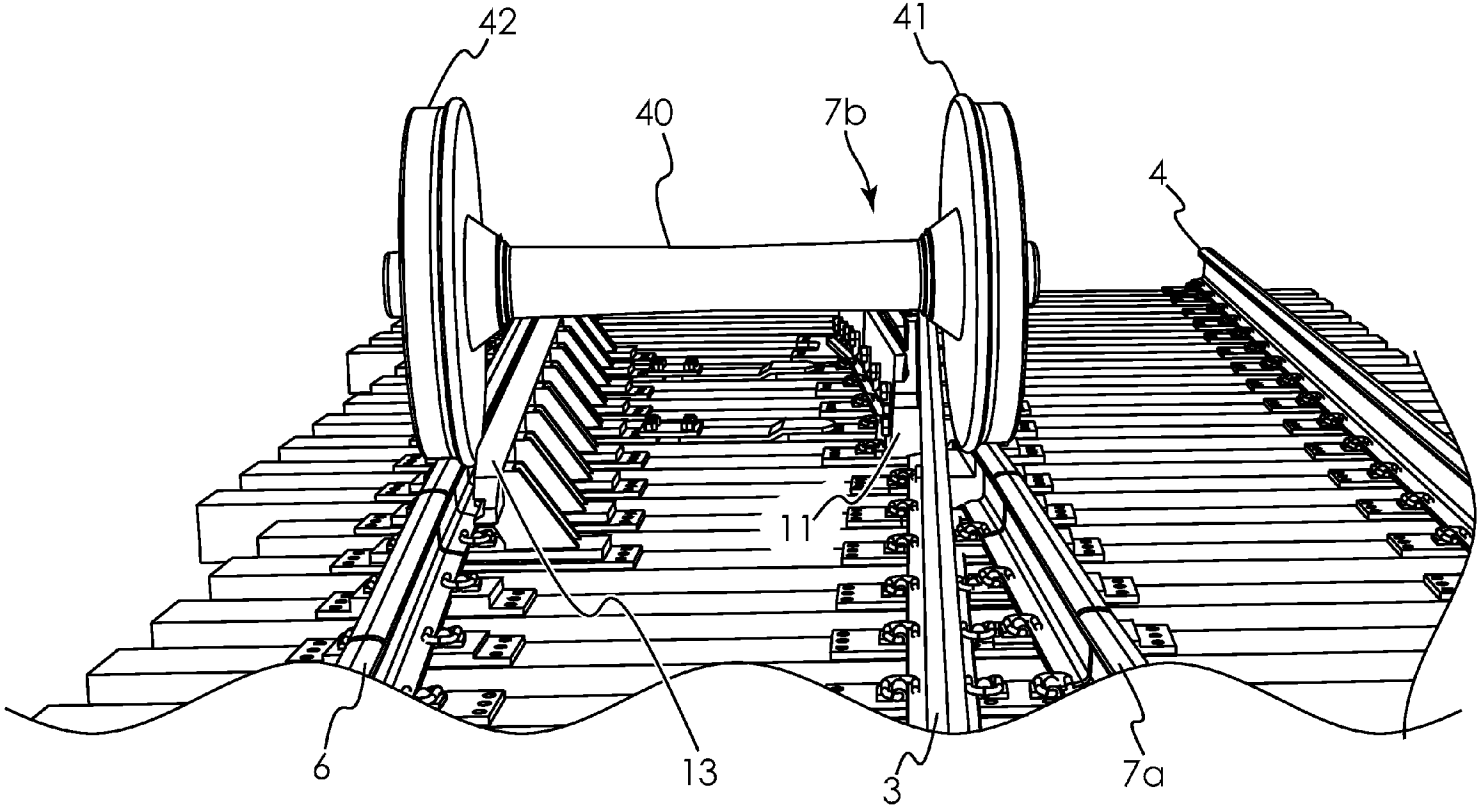
FIG. 14 is a detailed main line run perspective view of a railroad switch turnout panel assembly, in accordance with one embodiment of the present invention.
Figure 15:
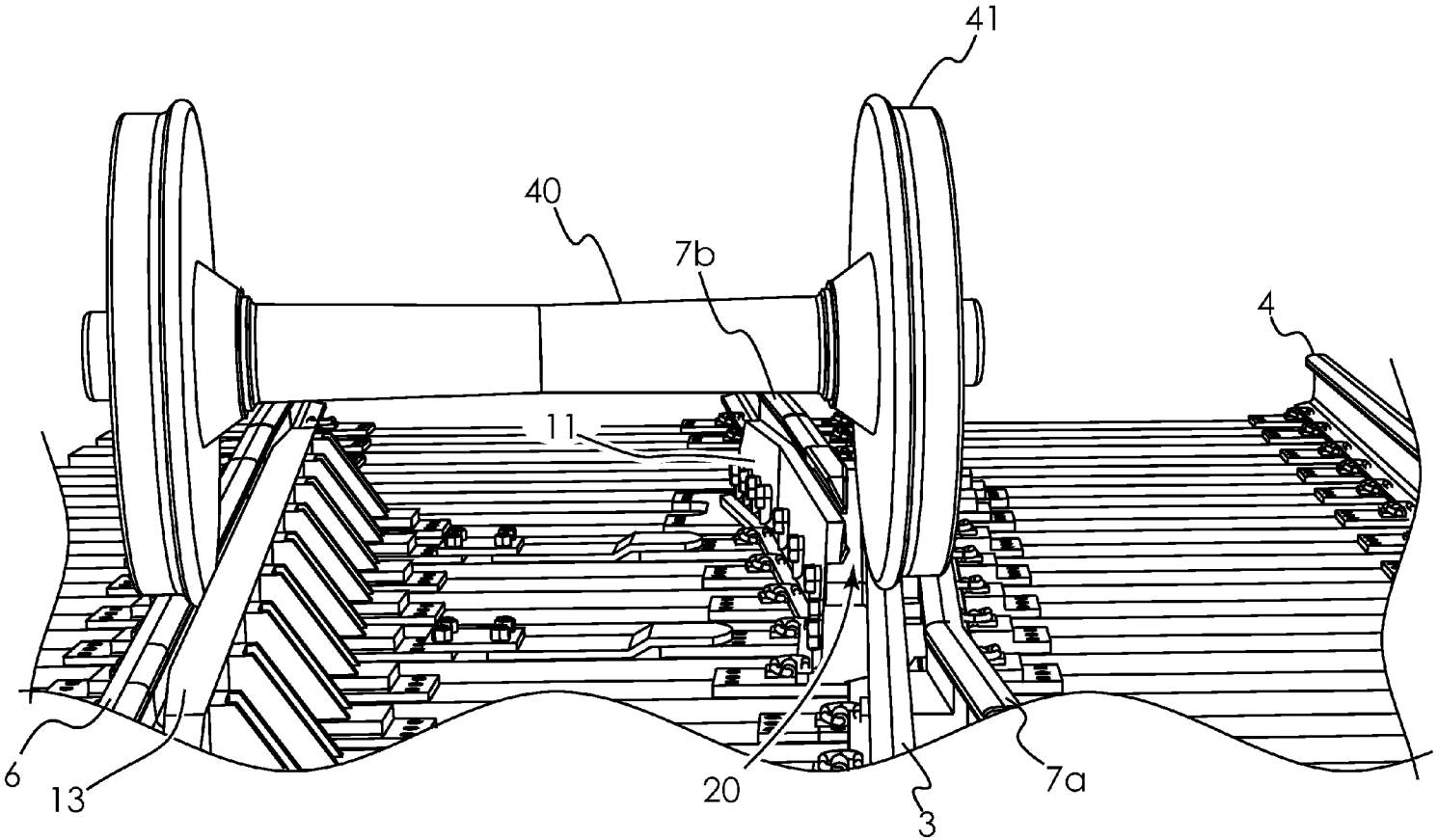
FIG. 15 is an upper rear side perspective view of a train wheel set as the inner wheel enters the transition zone above a main line rail, in accordance with one embodiment of the present invention.
Figure 16:
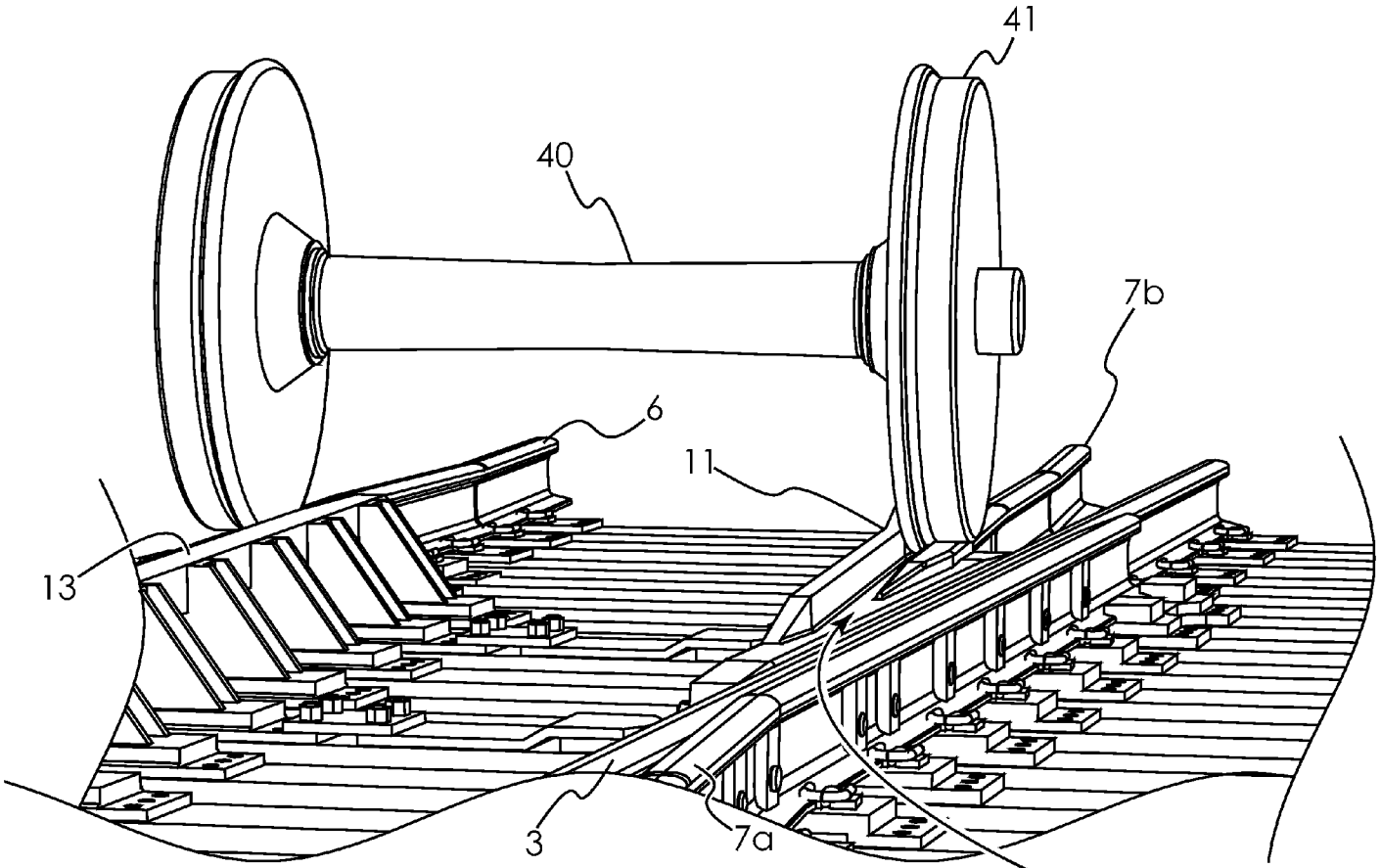
FIG. 16 is a detailed rear perspective view of a train wheel set as the inner wheel passes through the transition zone above a main line rail, in accordance with one embodiment of the present invention.

The operation of the railway switch turn-out panel assembly of the present invention may also be appreciated from FIGS. 14, 15 and 16.

FIG. 14 is a detailed main line run perspective view of a railroad switch turnout panel assembly and showing a wheel set in its position as it approaches the transition zone, in accordance with one embodiment of the present invention. This view shows a train wheel 40 set as the inner wheel enters the transition zone above a main line rail 3. At this point, the right side wheel 41, owing to the vertical bend in toe side rail portion 7*a*, has been raised to a height sufficient to pass over main line rail 3. At the same time, the flange of the left side wheel 42 is captured by guard rail as the corresponding vertical bend in outside turnout rail 6 maintains it at a level corresponding to that of heel side rail portion 7*b*.

FIG. 15 is a detailed rear perspective view of a train wheel set as the right side wheel 41 passes through the transition zone above a main line rail 3 to be supported by and captured by the flangeway floor 20 of frog 11.

FIG. 16 is a rear perspective view of a train wheel set as the inner wheel engages the heel side frog after passing through the transition zone above a main line rail, in accordance with one embodiment of the present invention. In this view, the flangeway floor 20 captures the flange of right side wheel 41 and guides it as it passes through the transition zone, eventually receding so as to transition the wheel 41 into a tread bearing condition on the frog 11 itself, and eventually onto heel side rail portion 7*b*.

Figure 17:
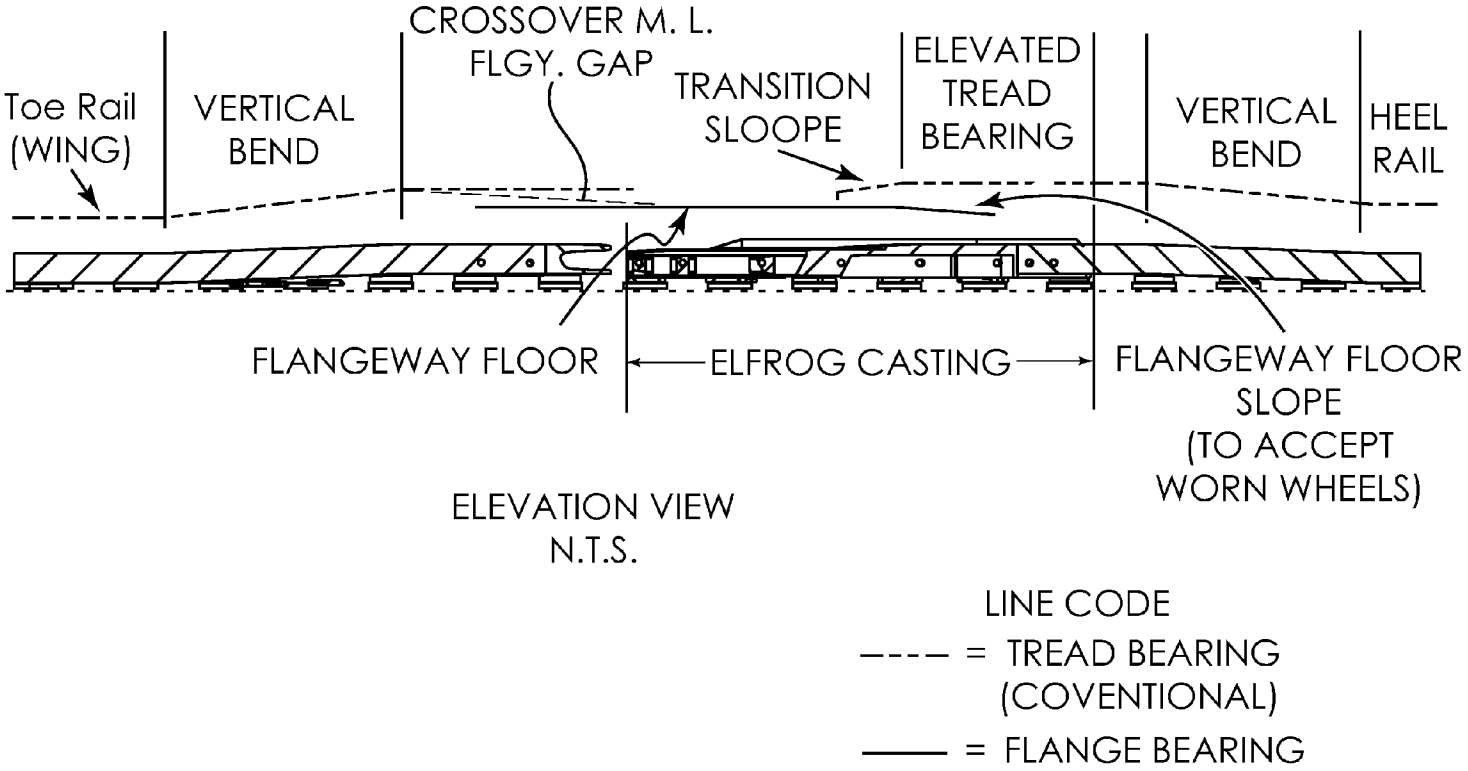
FIG. 17 is a rear perspective view of a train wheel set as the inner wheel engages the heel side frog after passing through the transition zone above a main line rail, in accordance with one embodiment of the present invention.

FIG. 17 shows an elevation schematic of the toe (or wing) rail, heel rail and frog casting, in accordance with the present invention. This view shows the path taken by the main line side wheel as it progresses along the inner turnout rail. This view shows the course of the wheel as it is raised by the vertical bend in the toe rail to a crossover M. L. flangeway gap, from which point the wheel is supported by the elevated frog and maintained substantially horizontally to a point where the transition slope of the frog allows the wheel to transfer from a flange-bearing condition to a tread-bearing condition on the frog and further onto the heel side turnout rail.

FIGS. 18-21 are detailed perspective views of the frog 11 used in accordance with the present invention.

Figure 18:
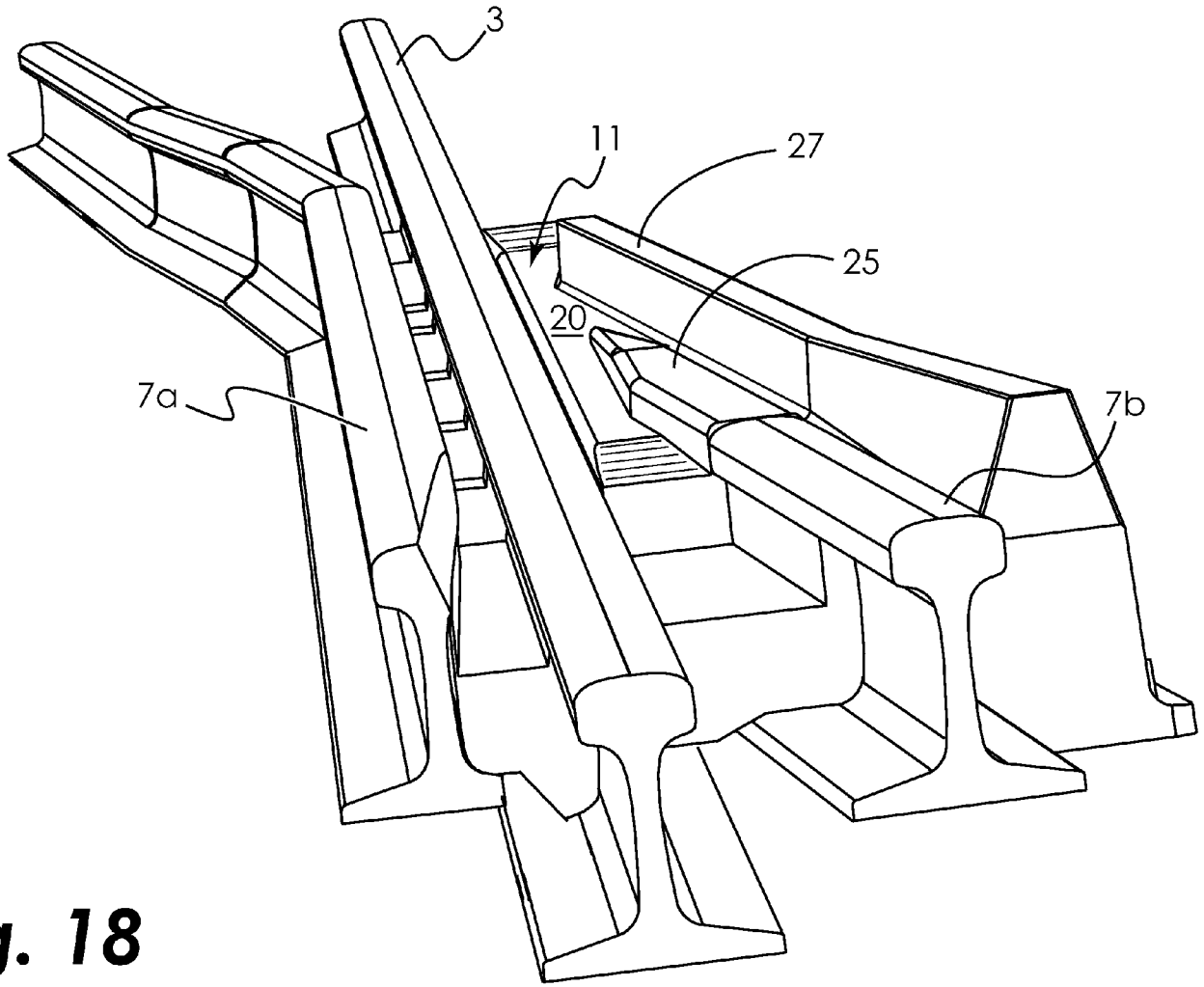
FIGS. 18-21 are detailed perspective views of the frog used in accordance with one embodiment of the present invention.

FIG. 18 is a detailed heel-side main line run perspective upstream view of a crossover point of a railroad switch turnout panel assembly. This view shows a detailed perspective of the main line rail 3, and the toe side turnout rail 7*a*. This also details the path taken by the flange of the crossing wheel as it passes over the main line rail, and onto flangeway floor 20. The position of the flange is maintained by guard portion 27, and the inner wall of the elevated tread-bearing portion 25.

Figure 19:
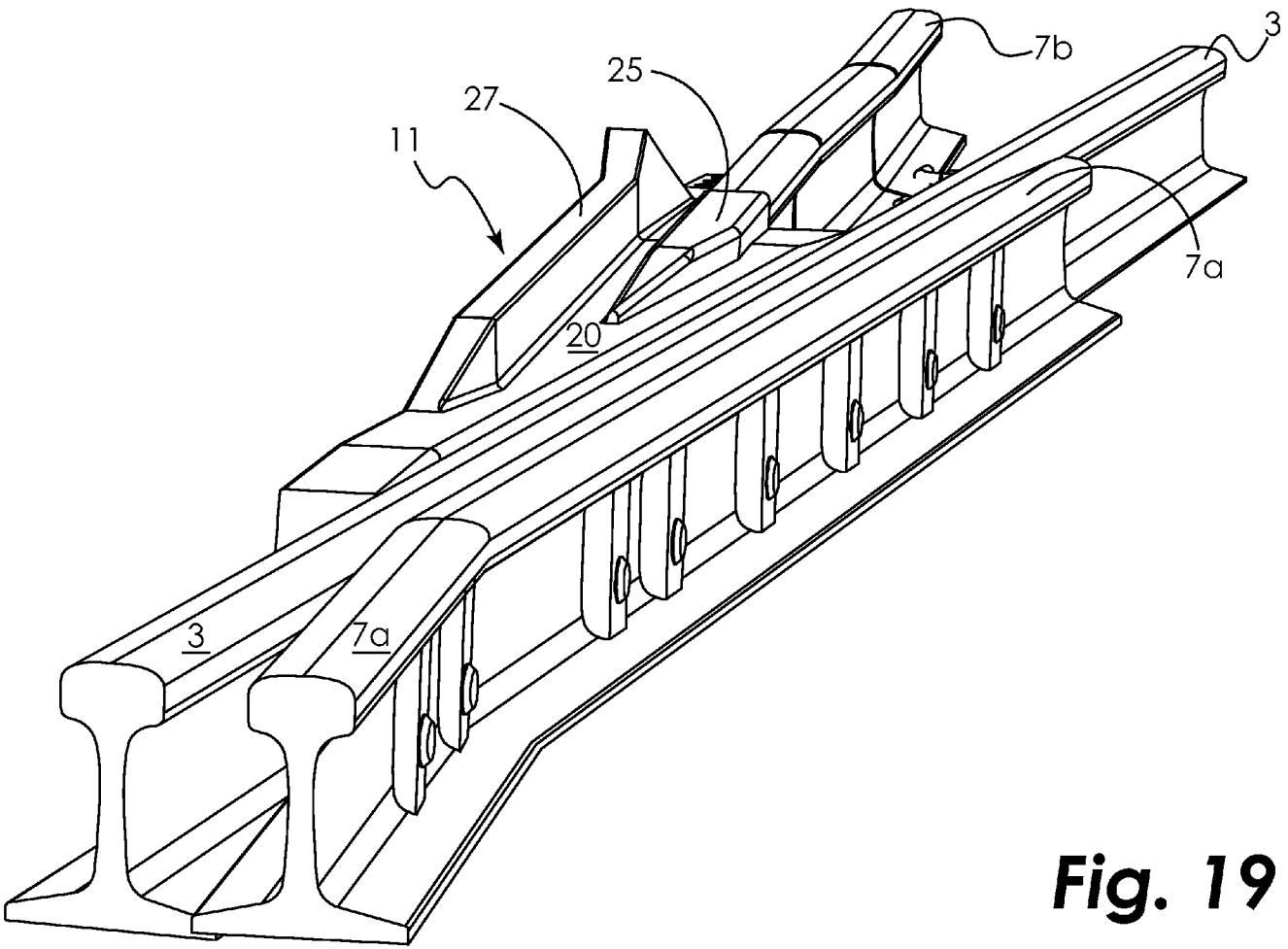

FIG. 19 shows a detailed toe-side main line run perspective downstream view of a crossover point of a railroad switch turnout panel assembly. This view especially elucidates the raising of the toe side turnout rail 7*a* to a level that allows a wheel to have its flange cross over to bear upon flangeway floor 20 which descends along an entry slope.

Figure 20:
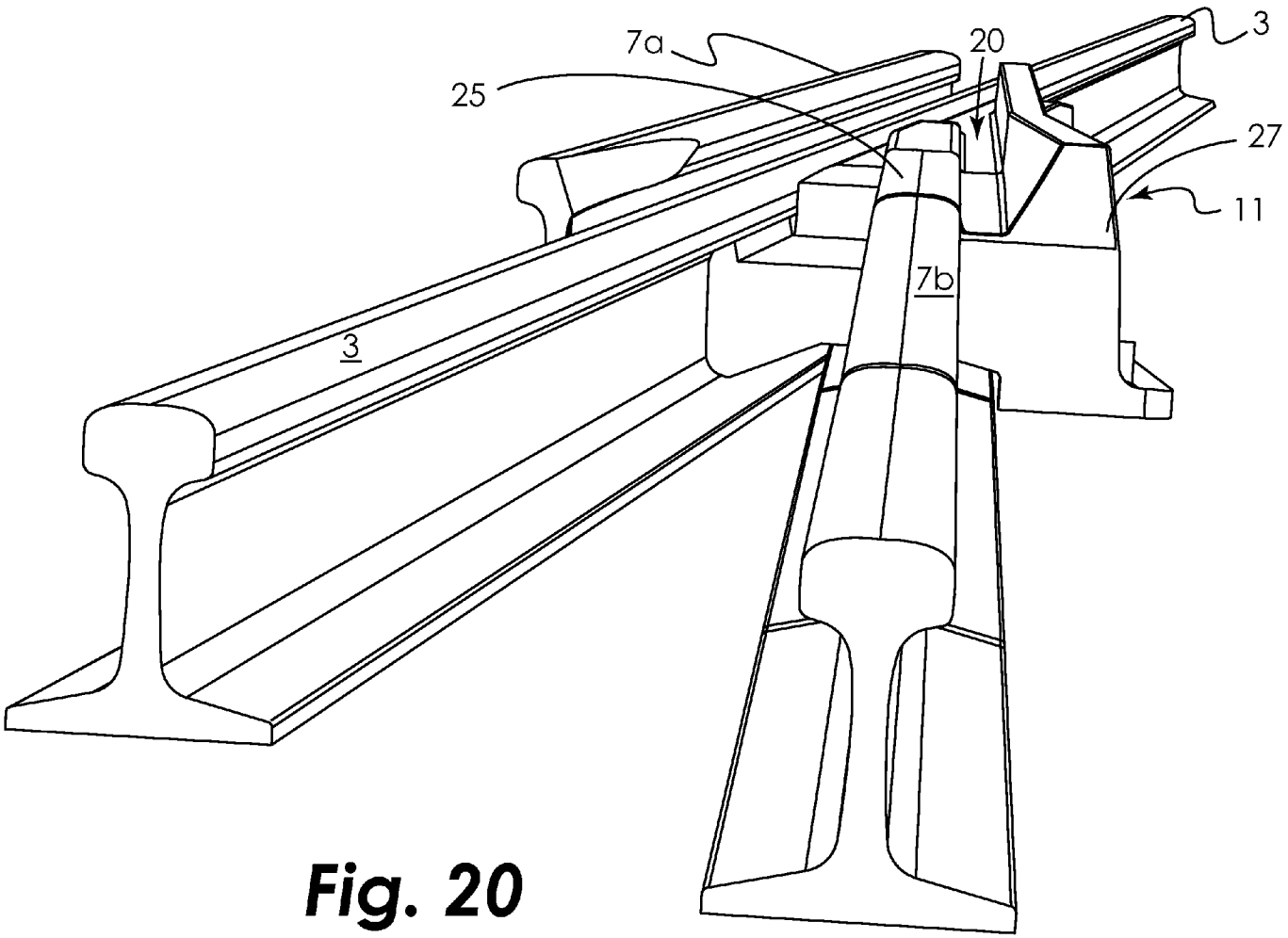

FIG. 20 is a detailed heel-side main line run perspective upstream view of the frog 11 that guides a wheel over a crossover point and through a transition zone of a railroad switch turnout panel assembly. This view shows a detailed perspective of the main line rail 3, and the toe side turnout rail 7*a*. This also details the path taken by the flange of the crossing wheel as it passes over the main line rail, and onto flangeway floor 20 which descends along its entry slope, which may be appreciated in this view.

Figure 21:
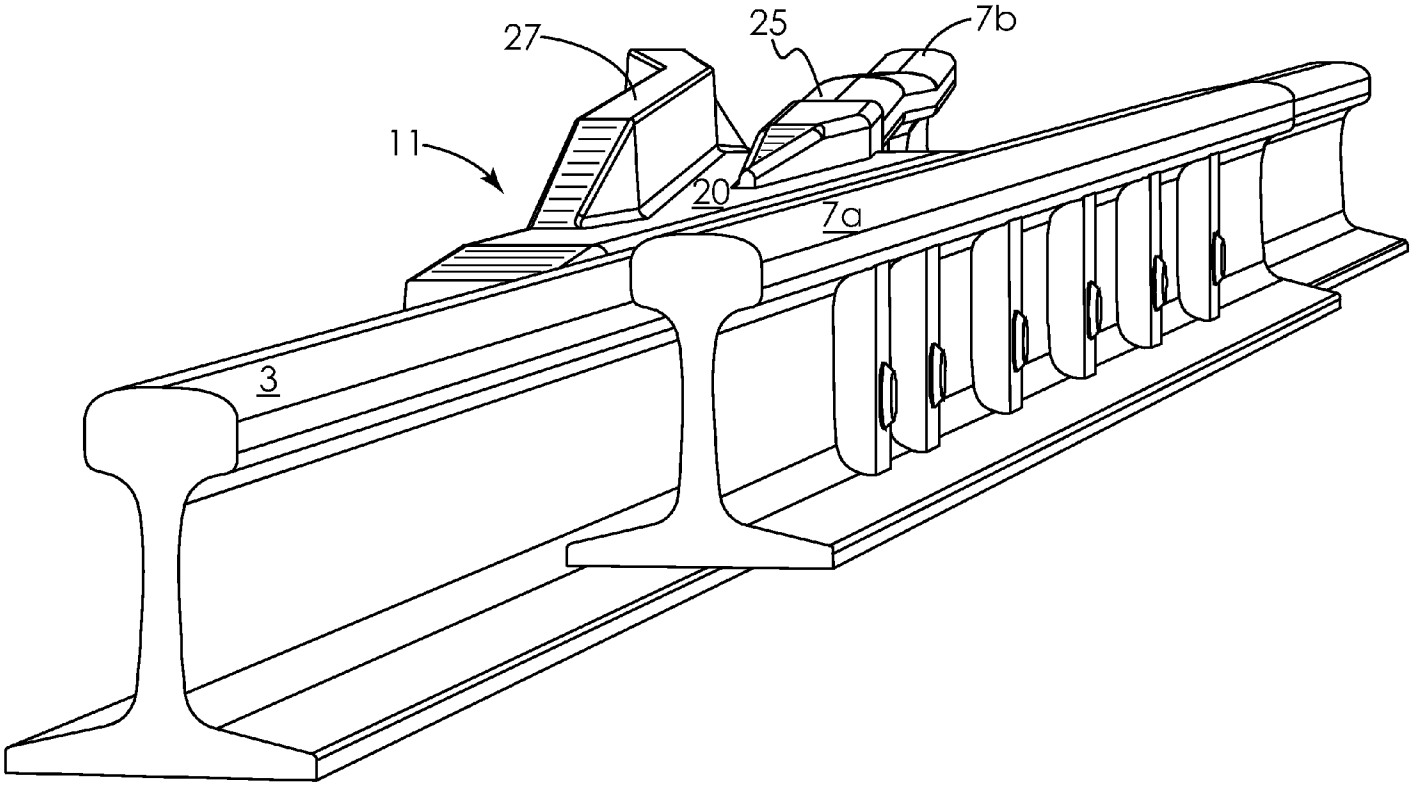

FIG. 21 shows a detailed toe-side main line run perspective downstream view of a crossover point of a railroad switch turnout panel assembly. This view also elucidates the raising of the toe side turnout rail 7*a* to a level that allows a wheel to have its flange cross over to bear upon flangeway floor 20 which descends along an entry slope, after first being maintained in a flange-bearing condition by guard portion 27 and the inner wall of the elevated tread-bearing portion 25 prior to descent.

The frog design of the present invention thus permits a regulated transition from flange to tread using a single heel-side frog that may be simply and inexpensively created without the use of complex machining, and with a frog panel design that may be effectively and efficiently created and maintained with little cost attendant to the typical wear on larger dual side frog casting systems and assemblies.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

What is claimed is:

1. A system for crossing a train on a side track over a main track, the system comprising:

a. a plurality of railroad ties;

b. a main rail having a continuous beam supported by said ties, said main rail having a main rail tread bearing surface;

c. a turnout side rail section supported by said ties and crossing the main rail, the side rail section being divided into a toe rail segment and a heel rail segment that are located on opposite sides of said main rail; said toe rail segment angled upwardly from the horizontal toward said main rail and terminating at a height; and d. a frog on the heel side of said main rail, said frog having a frog tread bearing surface disposed at a level higher than inner main rail crown, and being aligned with and secured to said heel rail segment, said heel rail segment angled upwardly from the horizontal toward said frog, said frog having a flange pathway having transitional flangeway floor having an upfield portion substantially level with said crown of said inner main rail, and a downwardly receding downfield portion, such that the flange of a railcar wheel of a train wheel set passing therethrough contacts said transitional flangeway floor prior to the tread of said wheel contacting said frog tread bearing surface said frog having a frog tread bearing surface disposed at a level higher than said main rail tread bearing surface, and being aligned with and secured to said heel rail segment, said heel rail segment angled upwardly from the horizontal toward said frog.

2. A system according to claim 1, said plurality of railroad ties having a series of at least two ties disposed beneath said toe rail segment, said series of ties being provided with respective riser plates adapted to maintain said toe rail segment angled upwardly from the horizontal toward said main rail.

3. A system according to claim 1, said plurality of railroad ties having a series of at least two ties disposed beneath said heel rail segment, said series of ties being provided with respective riser plates adapted to maintain said heel rail segment angled upwardly from the horizontal toward said frog.

4. A system according to claim 1, said plurality of railroad ties having a series of at least two ties disposed beneath said toe rail segment, said series of ties being provided with respective riser plates adapted to maintain said toe rail segment angled upwardly from the horizontal toward said main rail, and said plurality of railroad ties also having a series of at least two ties disposed beneath said heel rail segment, said series of ties being provided with respective riser plates adapted to maintain said heel rail segment angled upwardly from the horizontal toward said frog.

5. A system according to claim 1, wherein said main rail is canted.

6. A system according to claim 1, wherein said main rail is canted, and wherein said plurality of railroad ties have a series of at least two ties disposed beneath said main rail, said at least two ties being provided with respective riser plates that are adapted to maintain said main rail in a canted position.

7. A system according to claim 1, said main rail being canted and having a toe side and a heel side, said plurality of railroad ties having a first series of at least two ties disposed beneath both said toe rail segment and said toe side of said main rail, said first series of ties being provided with respective riser plates adapted to maintain said toe rail segment angled upwardly from the horizontal toward said main rail while maintaining said toe side of said main rail in a canted position, and said plurality of railroad ties also having a second series of at least two ties disposed beneath both said heel rail segment and said heel side of said main rail, said second series of ties being provided with respective riser plates adapted to maintain said heel rail segment angled upwardly from the horizontal toward said frog while maintaining said heel side of said main rail in a canted position.

8. A system according to claim 1, wherein said main rail is canted, and wherein said plurality of railroad ties have a series of at least two ties disposed respectively beneath said main rail, said at least two ties being provided with respective riser plates that are adapted to maintain said main rail in a canted position.

9. A system according to claim 1, wherein said heel rail segment is canted and wherein said frog tread bearing surface is disposed at an angle so as to accommodate the canting of said heel rail segment.

10. A system according to claim 1, wherein said frog tread bearing surface is flat substantially along its longitudinal axis.

11. A system according to claim 1, said toe rail segment having no toe-side frog portion adjacent thereto.

12. A system according to claim 1, wherein said toe rail segment additionally comprises a rail portion disposed substantially parallel to said main rail.

13. A system according to claim 1, additionally comprising an outside turn out rail, said outside turnout rail having a leading portion opposite said toe rail segment and angled upwardly from the horizontal in accordance with the upward angle of said toe rail segment, and a trailing portion opposite said heel rail segment and angled downwardly from the horizontal in accordance with the downward angle of said heel rail segment away from said main rail, and further comprising a guard rail disposed along one side of said outside turn out side rail for retaining a train in a proper lateral position with respect to said frog.

14. A system according to claim 13, said plurality of railroad ties having a series of at least two ties disposed beneath said leading portion of said turn out side rail, said series of ties being provided with respective riser plates adapted to maintain said leading portion of said turn out side rail angled from the horizontal, and said plurality of railroad ties also having a series of at least two ties disposed beneath said trailing portion of said turn out side rail, said series of ties being provided with respective riser plates adapted to maintain said trailing portion of said turn out side rail angled from the horizontal.

15. A rail arrangement for crossing a railcar wheel of a train wheel set on a side track over a main track, the system comprising:

a. a main rail having a continuous beam, said main rail having a main rail tread bearing surface;

b. a turnout side rail supported by said ties and crossing the main rail, the turnout side rail being divided into a toe rail segment and a heel rail segment that are located on opposite sides of said main rail; said toe rail segment angled upwardly from the horizontal toward said main rail and extending to a height sufficient to lift a rolling train wheel to a height sufficient to allow it to pass over said main rail, said toe rail segment having no toe-side frog portion associated therewith; and c. a frog on the heel side of said main rail, said frog having a frog tread bearing surface disposed at a level higher than said crown of said inner main rail, and being aligned with and secured to said heel rail segment, said heel rail segment angled upwardly from the horizontal toward said frog, said frog having a flange pathway having transitional flangeway floor having an upfield portion substantially level with said crown of said inner main rail, and a downwardly receding downfield portion, such that the flange of a railcar wheel of a train wheel set passing therethrough contacts said transitional flangeway floor prior to the tread of said wheel contacting said frog tread bearing surface said frog having a frog tread bearing surface disposed at a level higher than said main rail tread bearing surface, and being aligned with and secured to said heel rail segment, said heel rail segment angled upwardly from the horizontal toward said frog.

16. An arrangement according to claim 15, wherein said heel rail segment is canted and wherein said frog tread bearing surface is disposed at an angle so as to accommodate the canting of said heel rail segment.

17. An arrangement according to claim 16, wherein said main rail is canted.

18. An arrangement according to claim 17, wherein said toe rail segment additionally comprises a rail portion disposed substantially parallel to said main rail.

19. A frog casting for guiding a railcar wheel of a train wheel set on a turn out side rail over a main rail in intersecting alignment therewith, said train wheel, when first manufactured, having an original tread-flange distance, said frog comprising a base surface and a tread bearing surface, said frog tread bearing surface being flat substantially along its longitudinal axis, and said base surface adapted to maintain said frog tread bearing surface substantially horizontal when said base surface is placed upon a flat supporting surface, said frog additionally comprising a first and second flange way at a horizontal angle to one another, said first flange way provided with a downwardly angled bottom surface having an entry point level, the difference between the level of said frog tread bearing surface and said entry point level being greater than said original tread-flange distance.

20. A frog casting according to claim 19, wherein said distance is in the range of from about 1.20 to about 1.35 inches.

* * * * *